US006089626A

United States Patent [19]

Shoemaker

[11] Patent Number: 6,089,626

[45] **Date of Patent: *Jul. 18, 2000**

[54] SECURITY DEVICE FOR A MOVABLE CLOSURE AND METHOD THEREFOR

[76] Inventor: Rodney Shoemaker, 2490 Saint Clair Ave., Unit No. C., Simi Valley, Calif. 93063

[ * ] Notice: This patent is subject to a terminal disclaimer.

[21] Appl. No.: 09/364,590

[22] Filed: Jul. 30, 1999

Related U.S. Application Data

[63] Continuation-in-part of application No. 09/097,220, Jun. 12, 1998.

[51] Int. Cl.[7] ..... E05C 3/06

[52] U.S. Cl. ..... 292/216; 292/201; 292/DIG. 36; 70/DIG. 11; 49/197

[58] Field of Search ..... 292/216, 201, 292/199, 280, DIG. 25, DIG. 36, 341.14; 70/256, 257, 279.1, 278.7, 283, DIG. 8, DIG. 11; 49/197, 199, 200; 160/201

[56] References Cited

U.S. PATENT DOCUMENTS

| | | |
|---|---|---|
| 2,926,943 | 3/1960 | Leslie et al. . |
| 3,664,698 | 5/1972 | Stropkay . |
| 4,616,862 | 10/1986 | Ward . |
| 4,703,960 | 11/1987 | Lense . |
| 4,771,218 | 9/1988 | McGee . |
| 4,808,995 | 2/1989 | Clark et al. . |
| 4,819,379 | 4/1989 | Kenzelmann et al. . |
| 4,827,667 | 5/1989 | Jarvis . |
| 4,884,831 | 12/1989 | Emon . |
| 4,978,153 | 12/1990 | Hirsch et al. . |
| 4,979,384 | 12/1990 | Malesko et al. . |
| 4,996,795 | 3/1991 | Niswonger . |
| 5,001,861 | 3/1991 | Hahn . |
| 5,217,266 | 6/1993 | Kostler . |
| 5,497,641 | 3/1996 | Linde et al. . |
| 5,544,924 | 8/1996 | Paster . |
| 5,642,636 | 7/1997 | Mitsui . |

FOREIGN PATENT DOCUMENTS

| | | |
|---|---|---|
| 125958 | 11/1984 | European Pat. Off. . |
| 205471 | 10/1939 | Switzerland . |
| 635939 | 4/1950 | United Kingdom . |
| 2142078 | 1/1985 | United Kingdom . |

*Primary Examiner*—Teri Pham

*Attorney, Agent, or Firm*—Oppenheimer Wolff & Donnelly LLP

[57] ABSTRACT

A method and apparatus for selectively securing and unsecuring a movable closure to a support frame is provided. The security device of the present invention comprises a locking assembly attached to the frame and a securing element attached to the closure. The locking assembly comprises a first rotating element having a detent, a second rotating element being engaged with the first rotating element, and a rotating latching element being selectively engageable with the second rotating element. When the movable closure is secured, the detent of the first rotating element is securely coupled with the securing element.

36 Claims, 24 Drawing Sheets

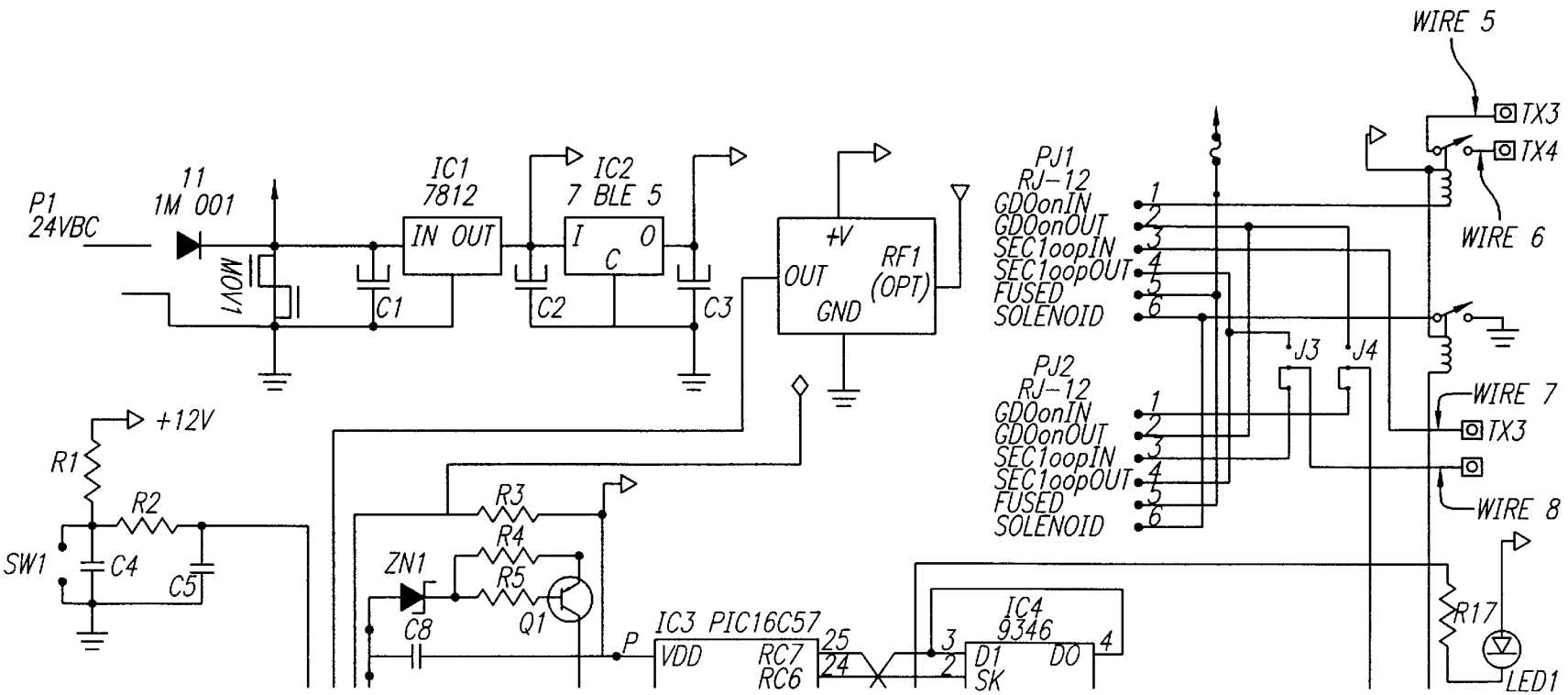
FIG. 24-A

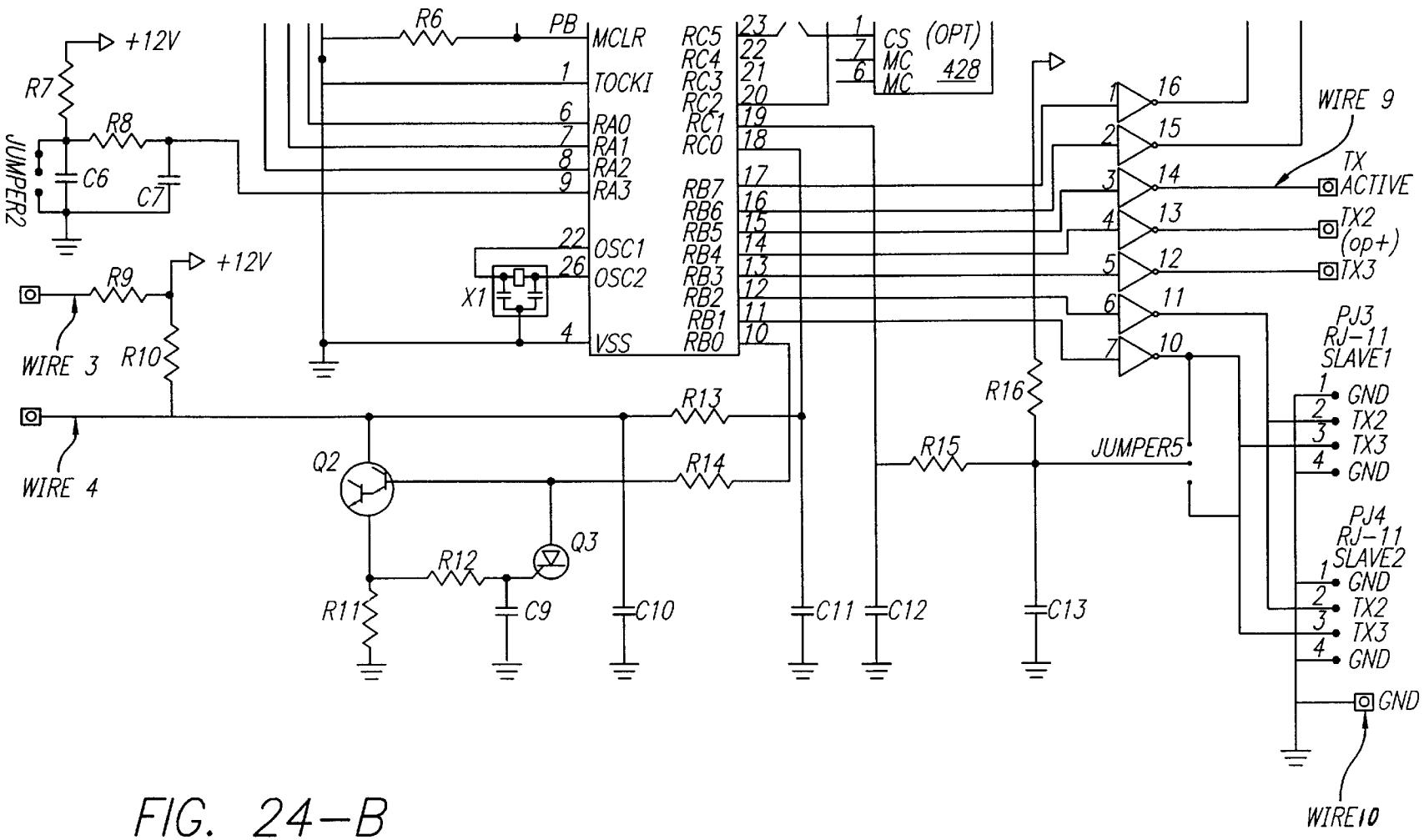
FIG. 24-B

SECURITY DEVICE FOR A MOVABLE CLOSURE AND METHOD THEREFOR

CROSS-REFERENCE TO RELATED APPLICATION

This is a continuation-in-part of copending application Ser. No. 09/097,220, filed Jun. 12, 1998. The entire content of this copending application is hereby incorporated by reference.

FIELD OF INVENTION

This invention generally relates to an apparatus and method for securing a movable closure, and relates in particular, to an apparatus and method for securing a movable closure such as a door to its support frame. The invention is applicable, but not limited to, movable closures that are connected to an opening mechanism which moves the closure from its closed position to an opened position, and to closures that are manually moved from their closed position to an opened position.

BACKGROUND OF THE INVENTION

A typical garage door assembly includes a solid door pivotally mounted in a door frame. From a closed position, the door can move pivotally upwardly and rearwardly to an overhead, approximately horizontal position. Another type of garage door assembly includes a garage door partitioned into several members. These several members are guided by rollers connected to a track system.

Various methods exist today for securing such garage doors to prevent any unauthorized entry by an intruder into the garage. Many residences often have a garage door secured by a padlock. These padlocks are generally located on the outside surface of the garage door and are, therefore, subject to unauthorized manipulation. Padlocks or other locks often have proven insufficient to overcome the strength and/or ingenuity of an intruder. Further, garages having garage door openers provide little security and often sacrifice security for convenience. Garage door openers comprise chain driven door openers, belt-driven door openers, and shaft driven openers and the like. Regardless of the type of garage door equipped with a garage door opener, an intruder can open such garage doors with relative ease because there is usually sufficient play in the joints, tracks, carriage, and drive connections to permit wedging of the door bottom and unauthorized entry.

Apparatuses and methods for securing garage doors are well known in the art. However, there remains a need to improve these known garage door locks. For example, the currently available garage door locks may not provide adequate security against an unauthorized entry. Other garage door locks may be overly complex and require delicate adjustments and constant maintenance in order to function reliably. Others are inconvenient in that they are not capable of being opened using a remote control, and thus do not take advantage of such technology.

OBJECT OF THE INVENTION

It is an object of this invention to provide a security device and method therefor that conveniently secures a movable closure.

It is another object of this invention to provide a security device and method therefor that conveniently secures a movable closure which is movable by a mechanical opening element.

It is yet another object of this invention to provide a security device and method therefor that conveniently secures a garage door to a garage door frame.

It is still another object of this invention to provide a security device and method therefor that conveniently secures a garage door to a garage door frame, the garage door being movable by a garage door opener which opens and closes the garage door.

It is still another object of this invention to provide a security device and method therefor that conveniently secures and is compatible with pre-existing closures, wherein the security device and method therefor is safe, reliable, easy to install and use, and inexpensive.

It is still another object of this invention to provide a security device and method therefor that conveniently secures and is compatible with pre-existing garage doors with garage door openers, wherein the security device works simultaneously and in conjunction with the existing garage door openers.

It is still another object of this invention to provide a security device and method therefor that secures a closure from unauthorized entry by using a locking gear system.

It is still another object of this invention to provide a security device and method therefor that secures a closure from unauthorized entry by using a locking bracket system.

SUMMARY OF THE INVENTION

In accordance with the present invention, a security device for securing a closure that is movable within a support frame from a secured position to an unsecured position and back is provided. The present invention achieves the objectives of preventing unauthorized entry while being safe, reliable, easily installed, and easily operated. The security device of the present invention also provides the benefits that it is capable of being operated from a remote location and that it is capable of being operated with a closure that is moved to and from its opened position by an automatic means for opening and closing the closure.

In general, the present invention achieves the foregoing objectives through the use of a locking assembly and a securing element. The locking assembly may be coupled to the support frame of the closure with the securing element coupled directly to the closure. The locking assembly may also be coupled directly to the closure with the securing element coupled to the stationary frame. The locking assembly comprises a first rotating element having a detent, a second rotating element being engaged with the first rotating element, and a rotating latching element being selectively engaged with the second rotating element. When the movable closure is secured, the detent of the first rotating element is securely coupled with the securing element. The coupling of the detent of the first rotating element with the securing element provides the ability of the present invention to secure the movable closure to its support frame, thereby preventing unauthorized entry through the movable closure.

The present invention provides a simple means for unsecuring the closure and permitting the user to move the closure from its secured position to its unsecured position. As discussed above, when the security device is in its secured position, the securing element is coupled to the first rotating element within the detent of the first rotating element. Thus, to move the securing device to its unsecured position, the securing element must be removed from the detent of the first rotating element. This is achieved by the movement of the rotating latching element and its disengagement from the second rotating element.

The rotating latching element is coupled with a spring element which forces the rotating latching element to rotate towards the second rotating element. Thus, to be disengaged from the second rotating element, the rotating latching element must be rotated against the force of the spring element. The latching element is so rotated by various means, including an actuator coupled to the rotating latching element. In this embodiment, the actuator has an actuator element which moves from a first position to a second position. This actuator element may be coupled to a wire element, which is also coupled to the rotating latching element. When the actuator is energized, the rotating latching element moves from its first position to its second position, thus causing the wire element to pull against the spring element force on the rotating latching element, causing the rotating latching element to disengage from the second rotating element. In another embodiment, the operator exerts a manual force on the rotating latching element through a manual release element.

When the rotating latching element is disengaged from the second rotating element, the first rotating element, which is also engaged to the second rotating element, becomes free to rotate. Thus, when the rotating latching element is disengaged from the second rotating element and as the closure is moved to its open position, the securing element forces the first rotating element to rotate towards its unsecured position. As the first rotating element rotates towards its unsecured position, the securing element becomes disengaged from the detent of the first rotating element, thereby freeing the securing element from the detent. The first rotating element is coupled with a spring element which forces the first rotating element to remain in the unsecured position. The closure thus becomes unsecured from its supporting frame and the user is free to move the closure to its opened, unsecured position.

The closure is moved to its closed and secured position by similar steps. When the user moves the closure to its closed position, the securing element begins to engage the detent of the first rotating element, thereby causing the first rotating element to rotate against the force of the spring element that is coupled with the first rotating element. As the first rotating element rotates, the second rotating element, which is engaged with the first rotating element, also rotates. The second rotating element has protrusions on its outer circumference, which engage a locking surface on the rotating latching element, thereby re-engaging the rotating latching element with the second rotating element, thereby locking the locking assembly and securing the securing element within the detent of the first rotating element.

In a second embodiment, the locking assembly comprises a locking element having a detent and a latching element being selectively engaged with the locking element. When the movable closure is secured, the detent of the locking element is securely coupled with the securing element. To move the securing device to its unsecured position, the securing element must be removed from the detent of the locking element. This is achieved by the movement of the latching element and its disengagement from the locking element.

The latching element is coupled with a spring element which forces the latching element to rotate towards the locking element. Thus, to be disengaged from the locking element, the latching element must be rotated against the force of the spring element. In this embodiment, the latching element is rotated by an actuator. The actuator has an actuator element which moves from a first position to a second position. This actuator may be coupled to a pivoting element, which is also coupled to the latching element. When the actuator is energized, the latching element moves from its first position to its second position, thus causing the pivoting element to pull against the spring element force on the latching element, causing the latching element to disengage from the locking element. In another embodiment, the operator exerts a manual force on the latching element through a manual release element.

When the closure is moved to its open position, the securing element forces the locking element to rotate towards its unsecured position. As the locking element rotates towards its unsecured position, the securing element becomes disengaged from the detent of the locking element, thereby freeing the securing element from the detent. The closure thus becomes unsecured from its supporting frame and the user is free to move the closure to its opened, unsecured position. The locking element is coupled with a spring element which forces the locking element to remain in the unsecured position.

The closure is moved to its closed and unsecured position by similar steps. When the user moves the closure to its closed position, the securing element begins to engage the detent of the locking element, thereby causing the locking element to rotate against the force of the spring element that is coupled with the locking element. As the locking element rotates, it re-engages with the latching element, thereby locking the locking assembly and securing the securing element within the detent of the locking element.

The present invention provides the benefits to the user of the ability to remotely operate the securing device and the ability to operate the securing device in conjunction with an automatic device for opening and closing the closure. The actuator of the present invention may be energized by an electrical signal which causes the actuator element to move from its first position to its second position. This electrical signal may come from a radio frequency remote control, as is well-known in the art. Further, the radio frequency signal may also activate an automatic opening device. Thus, when the automatic opening device is activated, the actuator of the securing device can also be activated so that the closure can be unsecured and be automatically opened with the opening device with the same remote control signal.

The security device of the present invention is intended to be used with any movable closure, however, it is particularly useful with garage doors and automatic garage door openers, as are well-known in the prior art. The present invention is thus not intended to be limited to use with garage doors or automatic garage door openers.

Other objects, features, and advantages of the present invention will become apparent from a consideration of the following detailed description.

BRIEF DESCRIPTION OF THE DRAWINGS

FIG. 24 is a schematic circuit diagram of the electronics which controls the security device illustrated in FIG. 19.

DETAILED DISCUSSION OF THE PREFERRED EMBODIMENTS

Figure 1:
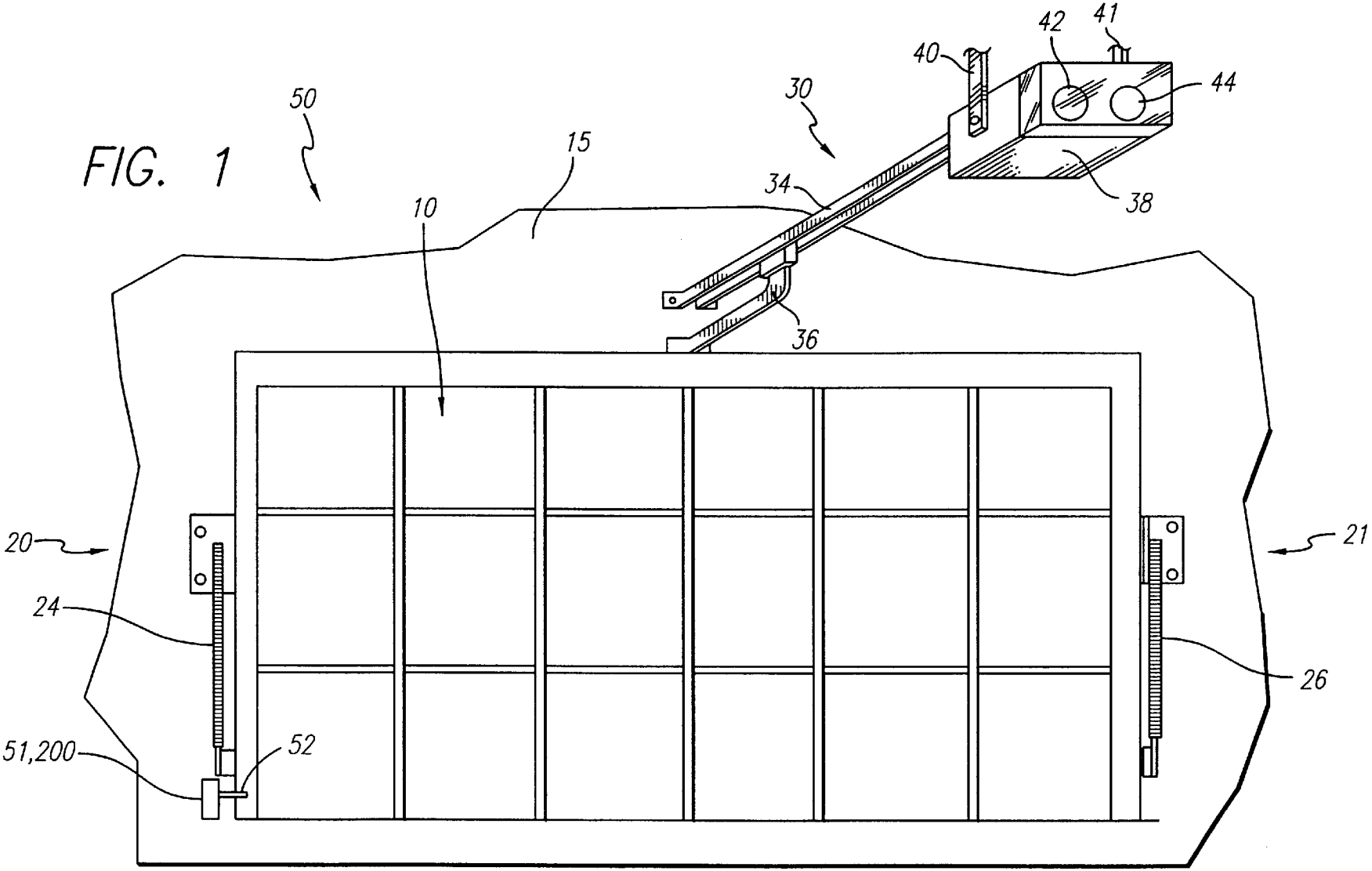
FIG. 1 is a perspective view of a typical garage door assembly with a garage door opener having the device of the present invention, the garage door being shown in the closed position.

The present invention relates to a security device for a movable closure which secures the closure to its frame and which is safe, reliable, convenient, easy to install and use, does not require major alterations to the existing opening system, does not require delicate adjustment and constant maintenance, and may even be coupled to an existing garage door opener so that it can be operated in conjunction with the garage door opener. The security device is suited for any type of closure that is supported within a stationary frame and that is moved from a closed position to an opened position and vice versa.

In the particular embodiment shown in the drawings and herein described, the movable closure is illustrated as a garage door opened and closed with a garage door opener. However, it should be understood that the principles of the invention are equally applicable to virtually any form of movable closure. Therefore, it is not intended to limit the principles of the present invention to the specific embodiments shown and such principles should be broadly construed.

Referring to FIG. 1, a garage door 10 is supported within a stationary support frame 15, the garage door 10 being a solid or single-piece assembly. The garage door 10 is mounted on the support frame by attaching pivoting side lever assemblies 20, 21 on each side of the garage door 10. The pivoting side lever assemblies 20, 21 are mounted on opposite sides of the support frame, and include counterbalancing springs 24, 26. As a result, the garage door 10 can be pivoted upwardly from a vertical closed position as shown FIG. 1 to an overhead horizontal position (not shown). Many other types of garage door assemblies exist such as a garage door assembly comprising a garage door partitioned into several members and guided by rollers connected to a track system. The present invention is intended to work equally well with either type of garage door or closure.

In accordance with the present invention, the closure may be opened and/or closed automatically using an automatic opening device, such as an electric garage door opener. It is not intended that the present invention be limited to closures having such opening devices—the present invention is intended to operate with both closures that include and do not include such openers.

A garage door opener 30 can comprise any of several designs, including chain driven door openers, belt-driven door openers, and shaft driven openers and the like (see FIG. 1). The garage door opener 30 shown herein includes a guide track 34 mounted on the horizontal portion of the support frame 15 with a chain (not shown) rotatably coupled about the length of the guide track 34. An opener arm 36 is slideably coupled at one end with the guide track 34 and driven by the chain. At the other end, the opener arm 36 is connected to the garage door 10. The garage door opener 30 also includes a housing 38 which is suspended by housing members 40, 41 attached to the ceiling of the garage (not shown). The housing 38 is also affixed to the end of the guide track 34 which is opposite the support frame 15. The housing 38 contains a controller 42 and an electric motor 44, wherein the controller 42 controls the electric motor 44. A signal can be sent to the controller 42 to either open or close the garage door 10 by an interior switch electrically coupled to the controller 42 with a wire, or by a remote switch coupled to the controller 42 via a radio frequency signal (see FIG. 17). Typically, the interior switch is a garage door opener button located on the garage door wall, and the remote switch is generally a remote opener carried in a motor vehicle. The electric motor 44 drives the chain, and the chain slides the opener arm 36 in a manner which opens and closes the garage door 10.

The operation of closing and opening the garage door 10 is as follows (see FIG. 1). When the garage door 10 is in the closed position, an operator engages either the garage door opener button or the remote opener, and a signal is sent to the controller 42 to energize the electric motor 44. The electric motor 44 slides the opener arm 36 along the guide track 34 and away from the support frame 15. The opener arm 36 carries the garage door 10 upwardly and away from the support frame 15 in a pivotal motion to a horizontal open position where the garage door opener 30 automatically stops. The operator can close the garage door 10 by engaging the garage door opener button or the remote opener. The garage door opener 30 will operate in a reverse manner, such that the electric motor 44 slides the opener arm 36 along the guide track 34 and toward the support frame 15. The opener arm 36 lowers the garage door 10 downwardly and toward the support frame 15 in a pivotal motion to a vertical closed position where the garage door opener 30 automatically stops. A subsequent actuation may reversibly actuate the garage door opener 30.

One of the principal problems of conventional garage door openers 30, such as the one described above, is the unauthorized opening of the garage door 10 without electrically actuating the garage door opener 30. In other words, the conventional garage door opener 30 can be overpowered by someone manually pulling the door open 10 from the outside. This means that security is compromised for the convenience of the garage door opener 30.

In order to further secure the garage door 10 in its closed position, the security device 50 of the present invention is provided. The security device 50 has a locking assembly 51. The locking assembly 51 can be mounted at any point along the support frame 15. In FIG. 1, the locking assembly 51 is shown mounted on the vertical portion of the support frame 15. If additional security is desired, more than one locking assembly 51 can be mounted to the support frame 15. There is a corresponding securing element which is shown in the drawings as a rod 52 attached to the side edge of the garage door 10 which can be selectively secured and unsecured by the locking assembly 51. Therefore, the garage door 10 is secured when locking assembly 51 secures the rod 52, and the garage door 10 is unsecured when the locking assembly 51 unsecures the rod 52. The securing element can be configured in various forms, such as a rod 52, as long as it is able to engage and disengage with the locking assembly 51. It is not necessary that the locking assembly 51 be attached to the support frame 15 and the rod 52 be attached to the garage door 10—these may be reversed in accordance with the present invention, so that the locking assembly 51 is attached to the garage door 10 and the rod 52 is attached to the support frame 15.

Figure 2:
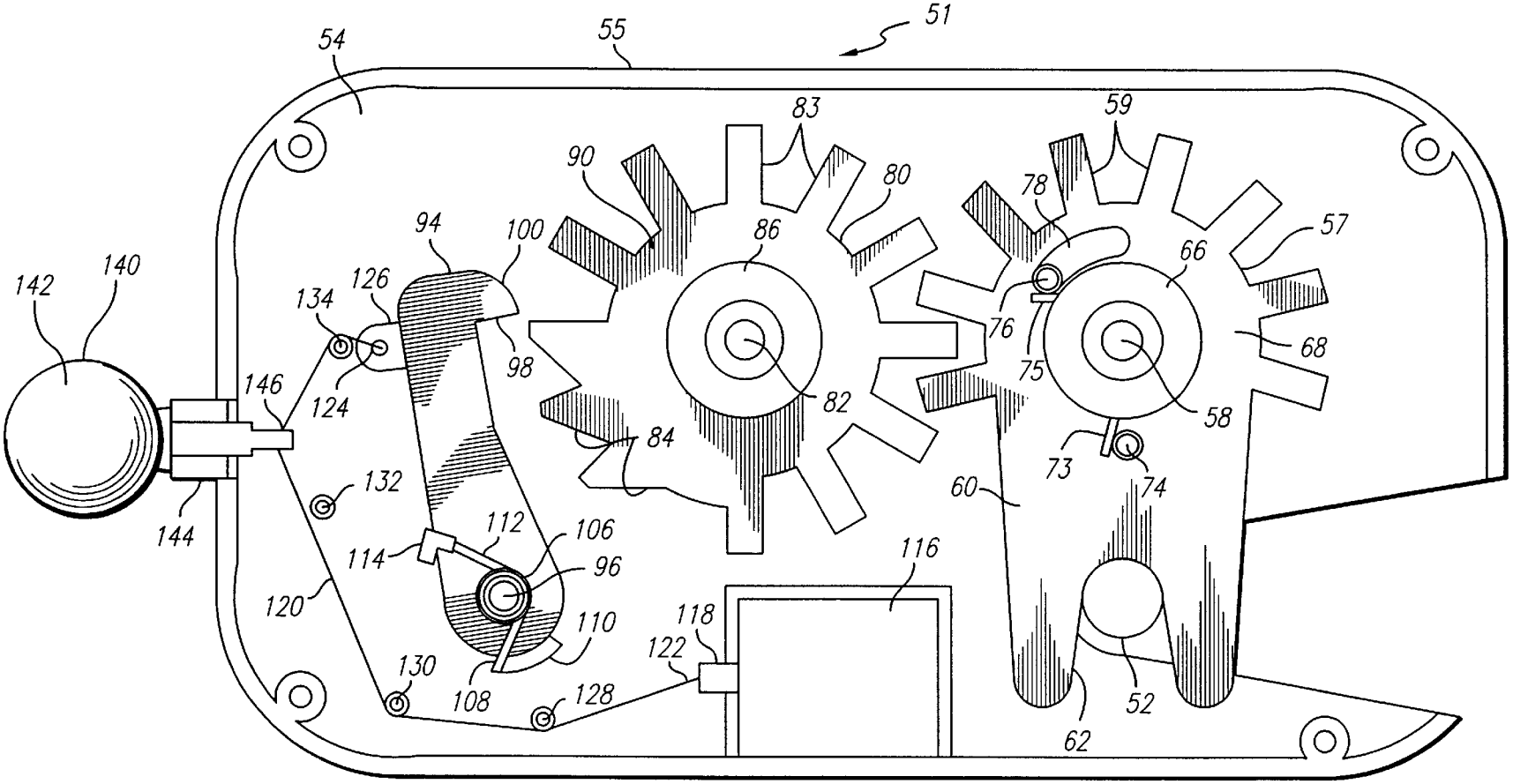
FIG. 2 is a close-up top view of the security device in its unsecured position with the garage door closed and about to be opened.
Figure 3:
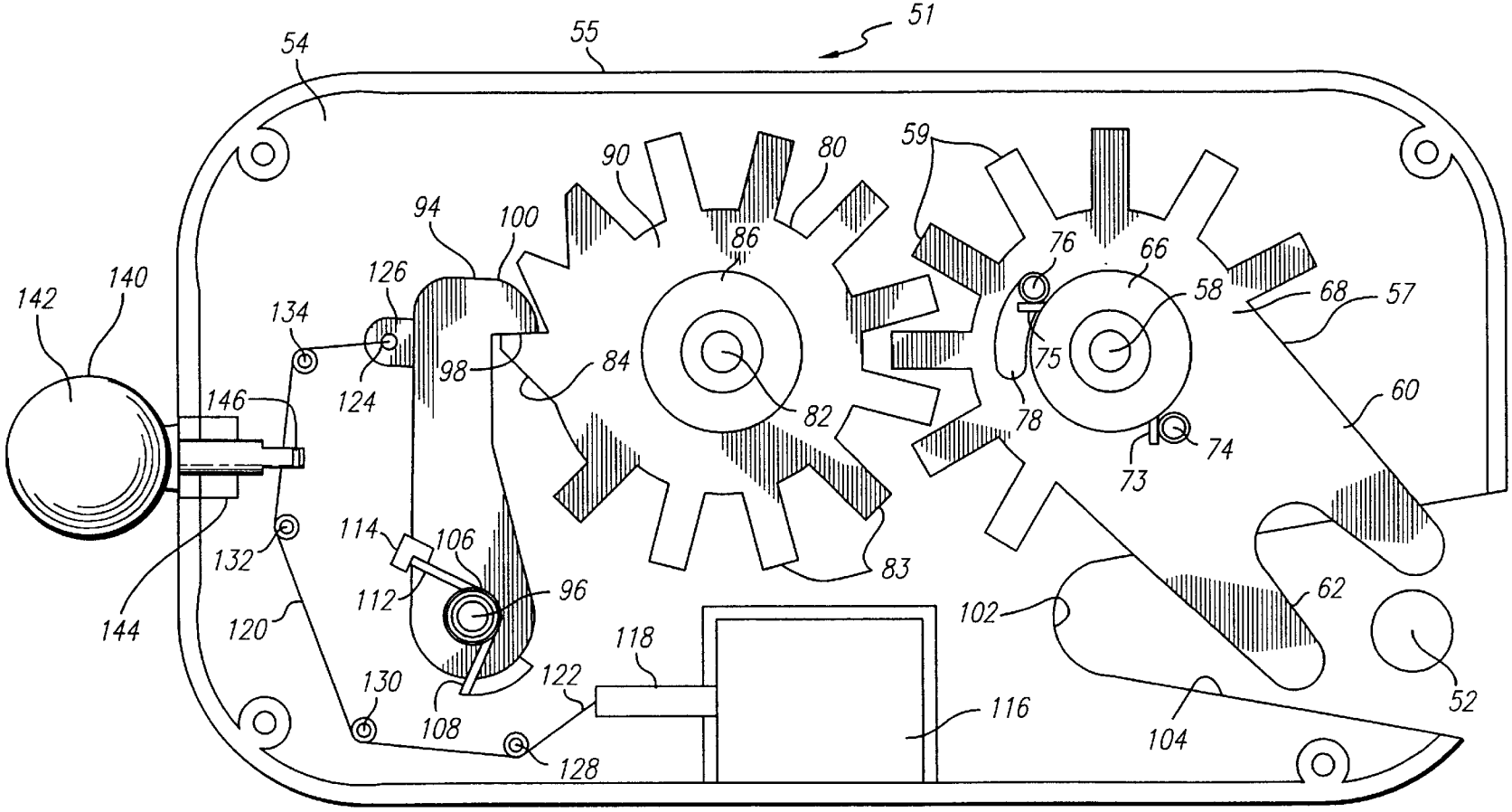
FIG. 3 is a close-up top view of the security device of the embodiment of the present invention shown in FIG. 2 in its secured position with the garage door opened and about to be closed.
Figure 4:
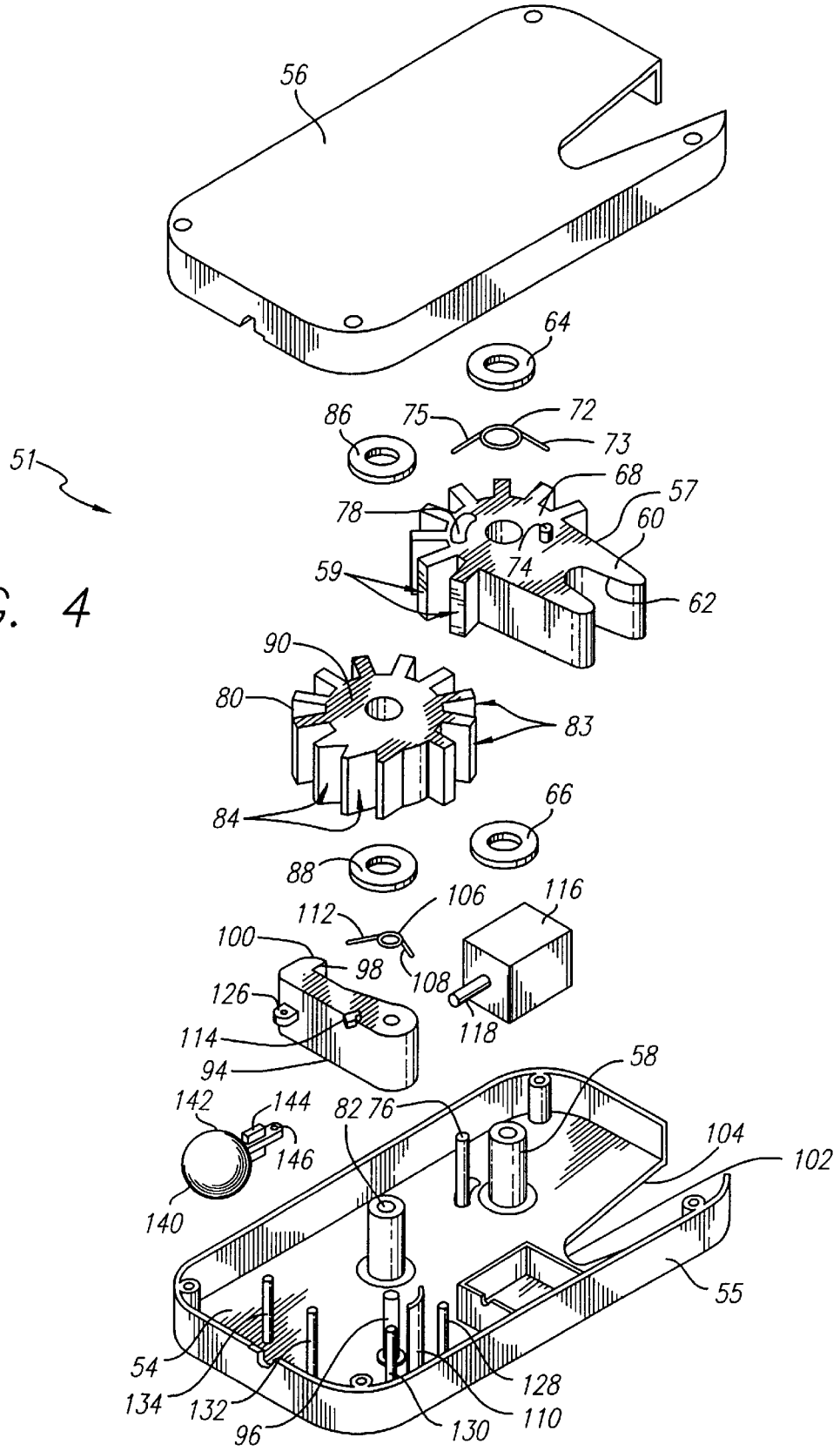
FIG. 4 is an exploded view of the security device of the embodiment of the present invention shown in FIGS. 2 and 3.
Figure 5:
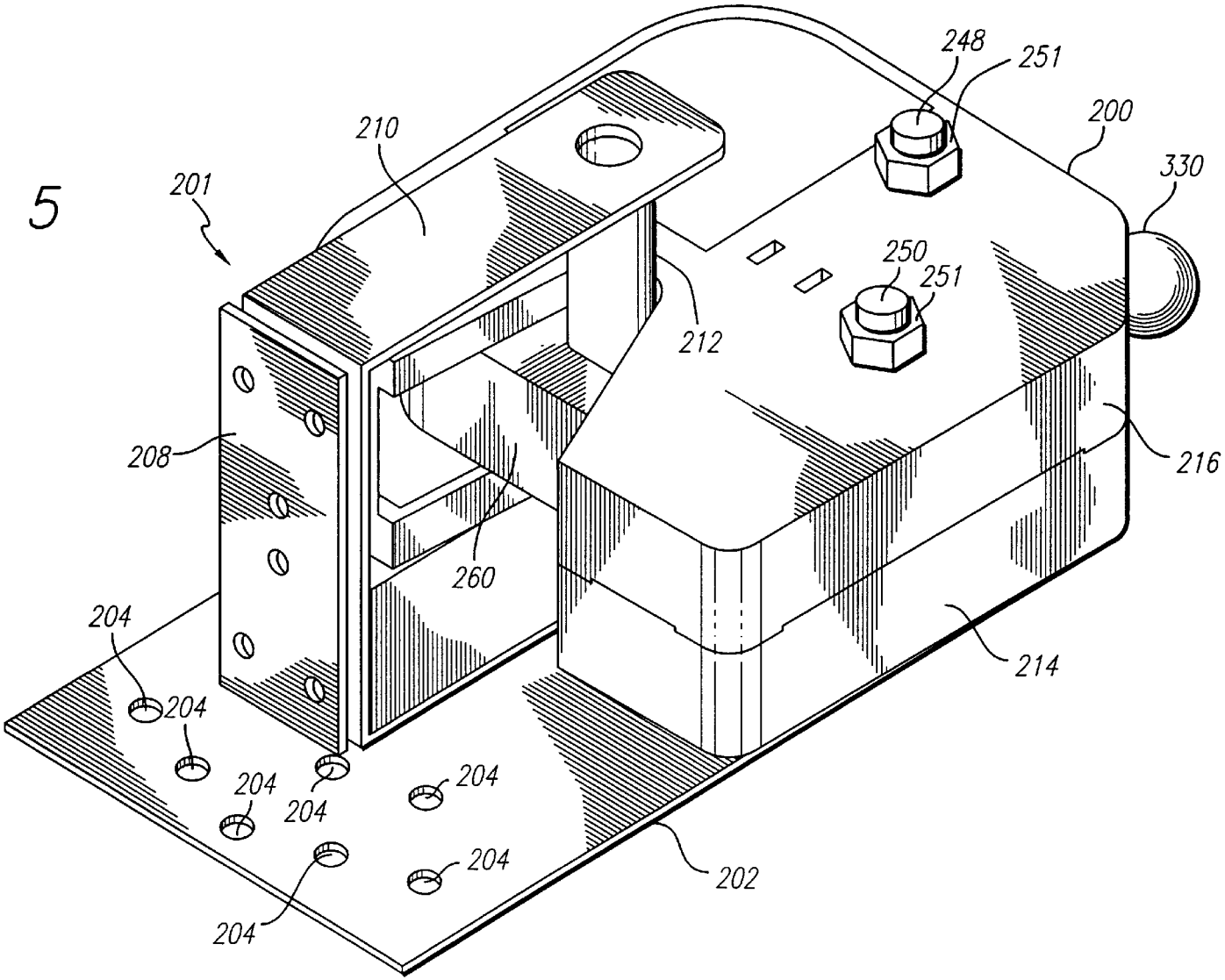
FIG. 5 is a perspective view of an alternative embodiment of the security device in its secured position with the garage door closed.
Figure 6:
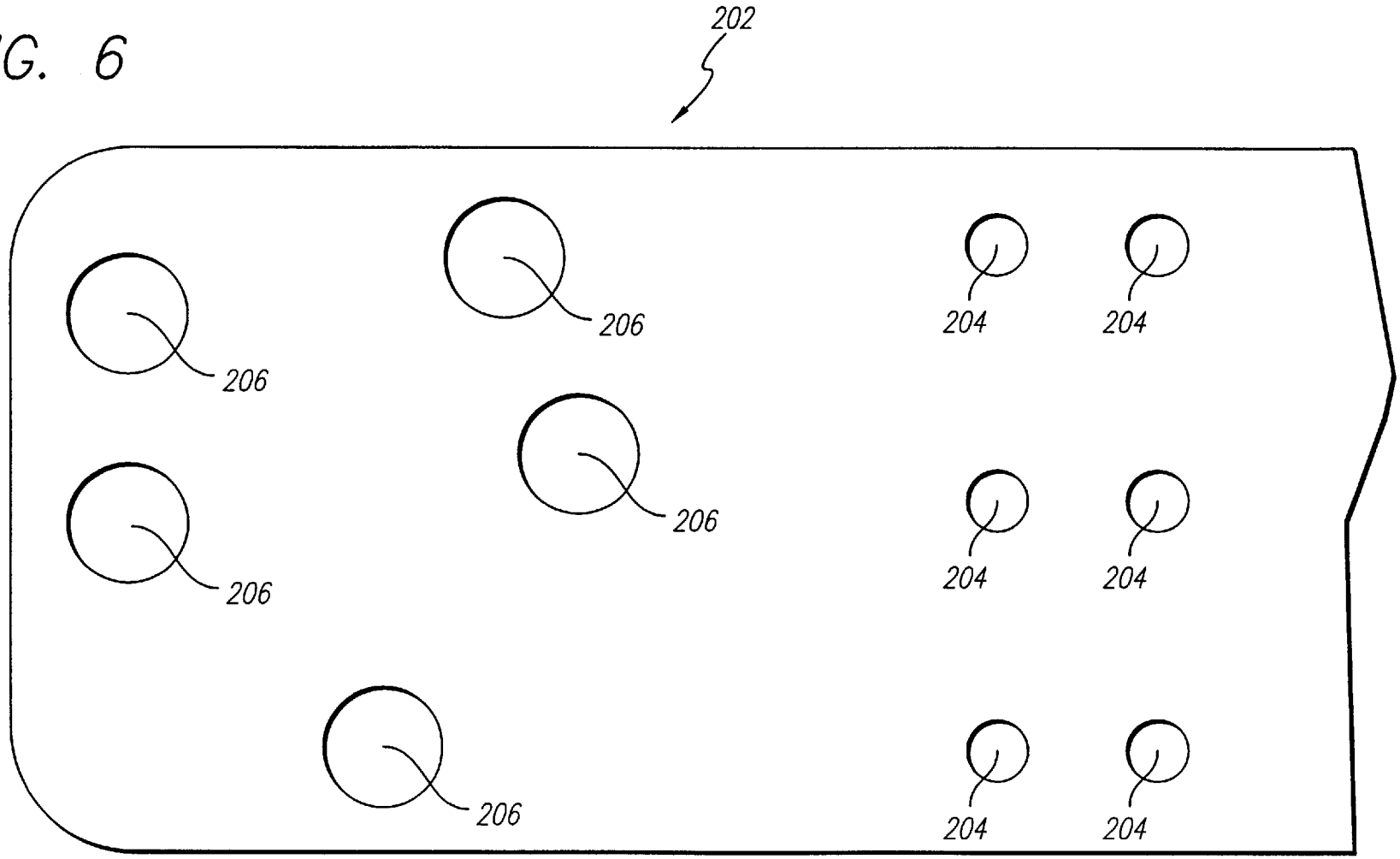
FIG. 6 is a close-up top view of a mounting bracket for the security device of the embodiment of the present invention shown in FIG. 5.

Referring now to FIGS. 2–4, the mechanism of the locking assembly 51 is shown. This mechanism includes a first rotating element or primary locking gear 57, a second rotating element or secondary gear 80, and a rotating latching element or latch hook 94. A base 54 is mounted on the support frame 15 by screws (not shown). Other types of fasteners can also be used such as bolts, nails, or clips. A first, second, and third shaft 58, 82, 96, respectively, are either attached to the base 54 or are fabricated integrally with the base 54. In order to protect the interior mechanism of the locking assembly 51 from the environment and to prevent exposure to the elements and prevent the potential for bodily injuries, the locking assembly 51 can be fully enclosed. One end of a side housing 55 is either attached or integrally formed with the base 54, and the other end of the side housing 55 is capped with a lid 56.

The primary locking gear 57 is rotatably mounted to the first shaft 58 (see FIGS. 2, 3, and 4). The primary locking gear 57 has rectangular teeth 59 and a detent, which is shown in the drawings as a fork 60, wherein the fork 60 has an U-shaped slot 62 which engages (see FIG. 2) and disengages (see FIG. 3) with the rod 52. The slot 62 can also have a rectangular or triangular shape, or any other shape which will engage and disengage with the rod 52. The primary locking gear 57 rotates about a first set of spacers 64, 66 adjacent to the top (68) and bottom tabs (not shown), respectively, of the primary locking gear 57.

In addition, the primary locking gear 57 is urged to rotate in a counterclockwise direction to its disengagement position with the rod 52 by a first torsion spring 72 (see FIG. 4). A first end 73 of the torsion spring 72 bears against a first pin 74 that extends out from the hub 68 of the primary locking gear 57, and the second end 75 of the torsion spring 72 bears against a second pin 76 that extends out from the base 54 and projects through the primary locking gear 57 via an arcuate slot 78 formed in the primary locking gear 57. The invention is not limited to torsion springs as shown in the drawings, but may be carried out with any other type of spring or mechanism which forces the primary locking gear 57 to rotate in one direction.

The secondary gear 80 is comprised of a region with substantially rectangular teeth 83 and another region with ramped teeth 84 (see FIGS. 2–4). The secondary gear 80 is mounted to the second shaft 82 in a manner where the rectangular teeth 83 of the secondary gear 80 are rotatively coupled with the rectangular teeth 59 of the primary locking gear 57. The secondary gear 80 rotates about a second set of spacers 86, 88 mounted on the top 90 and bottom hubs (not shown), respectively, of the secondary gear 80.

The latch hook 94, which is rotatably mounted to the third shaft 96, preferably has a locking surface 98 and a cam surface 100 (see FIGS. 2–4). The latch hook 94 engages (see FIG. 3) and disengages (see FIG. 2) with the secondary gear 80 at the locking surface 98. When the locking surface 98 is engaged with the secondary gear 80, the secondary gear 80 is restricted from rotating in the clockwise direction, but it is free to rotate in the counterclockwise direction because the cam surface 100 is able to ride along the ramped teeth 84. Correspondingly, the primary locking gear 57 is restricted from rotating in the counterclockwise direction, but it is free to rotate in a clockwise direction until it is stopped by either the rod 52 abutting against a vertex 102 of a V-shaped slot 104 formed in the base 54, or the cam surface 100 abutting against the substantially rectangular teeth 83. When the locking surface 98 is disengaged from the secondary gear 80, the secondary gear 80 is free to rotate in both the clockwise and counterclockwise directions, and correspondingly, the primary locking gear 57 can freely rotate in both directions.

The latch hook 94 is urged to rotate in a clockwise direction to its engagement position with the secondary gear 80 (see FIG. 3) by a second torsion spring 106 having a first end 108 bearing against an arcuate post 110 extending out from the base 54, and the second end 112 of the torsion spring 106 bears against a L-shaped tab 114 extending out from the latch hook 94 (see FIGS. 2, 3, and 4). Again, the invention is not limited to torsion springs, but can be carried out with any other type of spring or mechanism for forcing the latch hook to rotate in a clockwise direction.

The primary locking gear 57, secondary gear 80, and latch hook 94 are formed from a high strength metal such as steel. However, other materials having adequate strength and reliability such as polymers, plastics, or injection molded nylon, as is well-known to those of ordinary skill in the art, may be used if cost is a critical factor.

An actuator, which is mounted on the base 54 and side housing 55, causes the latch hook 94 to disengage from the secondary gear 80. In one embodiment of the present invention, the actuator is a solenoid 116 having a locking pin 118. The locking pin 118 is extended (see FIG. 3) when the solenoid 116 is de-energized and retracted (see FIG. 2) when the solenoid 116 is energized. The actuator may be any electronic solenoid or other device known in the art for selectively moving a pin or other element to and from an extended to a retracted position, such as pneumatic and hydraulic cylinders.

The solenoid 116 is coupled to the latch hook 94 by a braided wired 120. The first end 122 of the braided wire 120 is connected to the locking pin 118, and the second end 124 of the braided wire 120 is connected to a U-shaped tab 126 formed on the latch hook 94. Usually, the solenoid 116 is de-energized, the locking pin 118 is extended, and the latch hook 94 is engaged with the secondary gear 80. The latch hook 94 is in the engaged position because the tension on the braided wire 120 pulling on the latch hook 94 is less than the clockwise rotational force placed on the latch hook 94 by the torsion spring 106. When the solenoid 116 is energized, the locking pin 118 is retracted, the braided wire 120 pulls the latch hook 94, and the latch hook 94 rotates in the counter-clockwise direction and disengages with the secondary gear 80.

First, second, third, and fourth pulleys 128, 130, 132, 134 are mounted on the base 54. These pulleys 128, 130, 132, 134 guide the braided wire 120 from the locking pin 118 to the U-shaped tab 126. The solenoid 116 and latch hook 94 can be positioned in a manner which requires fewer or more pulleys, or, in certain configurations, no pulleys.

A manual release member 140 is coupled to the braided wire 120 between the third pulley 132 and the fourth pulley 134 (see FIGS. 2–4). The manual release member 140 comprises a spherical knob 142, which an operator can easily grasp, a body 144, and an opening 146. The braided wire 120 extends through the opening 146. An operator can manually unsecure the locking assembly 51 by simply pulling the spherical knob 142, thereby pulling the braided wire 120 in the same manner described above when the solenoid 116 is energized to cause the latch hook 94 to disengage from the secondary gear 80.

Figure 17:
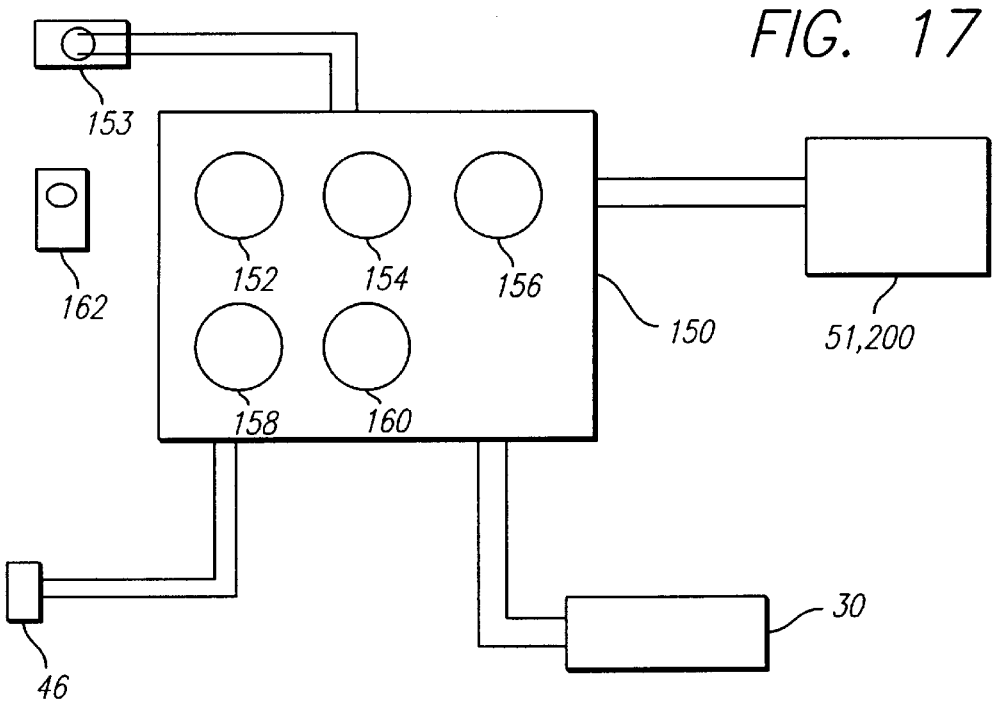
FIG. 17 is a block diagram of the electronics which controls the security device illustrated in FIG. 5 for a garage door equipped with a garage door opener.

FIG. 17 is a block diagram of a preferred embodiment of the electronics which control the security device 50 for a garage door 10 equipped with a garage door opener 30. An electronics module 150 includes an AC to DC power transformer 152, a radio frequency receiver 154, a timer element 156, solenoid relay 158, and electric motor relay 160 for the garage door opener 30. The electronics module 150 is coupled to the garage door opener 30, garage door opener button 46, locking assembly 51, 200, and radio frequency transmitter 162.

The AC to DC power transformer 152 is connected to a power supply such as standard electrical outlet 153. If the electronics module 150 is positioned near the housing 38 of the garage door opener 30, the electronics module 150 can be plugged into the same electrical outlet as the garage door opener 30. If an electrical outlet is not available, an adapter can be screwed into the light bulb socket of the garage door opener 30, and the electronics module 150 can be plugged into the adapter. Alternative power sources such as a battery may also be used.

The solenoid relay 158 and the electric motor relay 160 are activated when the radio frequency transmitter 162 sends a signal to the radio frequency receiver 154 or when the garage door opener button 46 sends a signal to the electronics module 150. The radio frequency transmitter 162 may incorporate anti-code scanning and transmitter programmable features. When the solenoid relay 158 and electric motor relay 160 are activated, the solenoid 116, 312 and electric motor 44 are energized. The timer element 156 is coupled to the solenoid relay 158 and allows the solenoid relay 158 to remain activated for a specified time interval, and therefore, allows the garage door opener 30 or an operator to open the garage door 10 before the solenoid 116, 312 is de-energized. Generally, the specified time interval can be approximately 5–10 seconds.

The present invention shown in FIGS. 2–4 and 17 operates in the following manner when the garage door 10 is equipped with a garage door opener 30. Presuming the garage door 10 is closed and secured, the rod 52 is engaged in the U-shaped slot 62 of the primary locking gear 57, the primary locking gear 57 is rotated to its full clockwise position, the secondary gear 80 is rotated to its full counterclockwise position, and the latch hook 94 is engaged with the secondary gear 80. The solenoid 116 is de-energized and the locking pin 118 is extended.

The garage door 10 can be opened and unsecured by an operator activating the solenoid 116 by engaging the garage door opener button 46 or radio frequency transmitter 162 (see FIGS. 1–4 and 17). The electronics module 150 energizes the solenoid 116, and the locking pin 118 of the solenoid 116 is retracted for the specified time interval. The locking pin 118 pulls the braided wire 120, and the braided wire 120 pulls the latch hook 94 away from its engagement with the secondary gear 80. The electric motor 44 for the garage door opener 30 is energized simultaneously with the solenoid 116, and the garage door 10 is carried towards a horizontal open position. As the garage door 10 is opening, the rod 52 forces the primary locking gear 57 to rotate to its full counter-clockwise position and the secondary gear 80 to rotate to its full clockwise position. As the primary locking gear 57 rotates in the counterclockwise direction, the rod 52 is released.

The electric motor 44 for the garage door opener 30 automatically stops when the garage door 10 is carried to the horizontal open position. The first torsion spring 72 forces the primary locking gear 57 to remain in the full counter-clockwise position and the secondary gear 80 to remain on the full clockwise position, wherein the primary locking gear 57 is positioned to accept the rod 52.

The garage door 10 can be closed and secured by engaging the garage door opener button 46 or the radio frequency transmitter 162 (see FIGS. 1–4 and 17). The electronics module 150 energizes the electric motor 44, and the electric motor 44 lowers the garage door 10 downwardly to a vertical closed position where the electric motor 44 automatically stops. The rod 52 is engaged in the U-shaped slot 62 of the primary locking gear 57, the primary locking gear 57 is rotated against the force of the first torsion spring 72 to its full clockwise position, the secondary gear 80 is rotated to its full counterclockwise position, and the latch hook 94 is engaged with the secondary gear 80. At this point, the garage door 10 is once again closed and secured.

Figure 18:
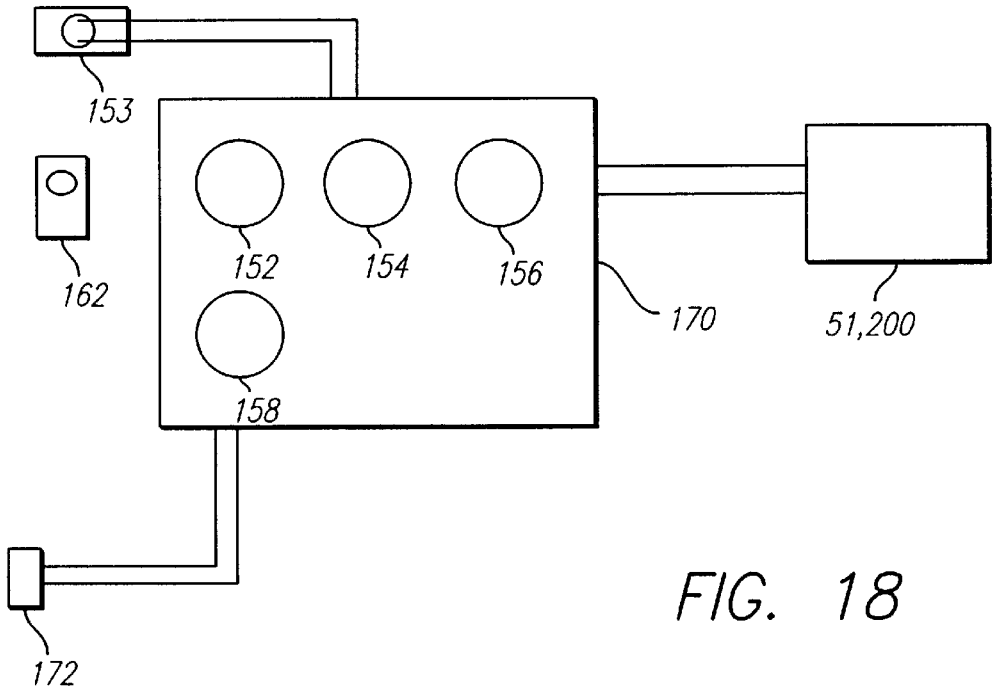
FIG. 18 is a block diagram of the electronics which controls the security device illustrated in FIG. 5 for a garage door not equipped with a garage door opener.

FIG. 18 is a block diagram of an embodiment of the electronics which control the security device 50 for a garage door 10 not equipped with a garage door opener. An electronics module 170 includes an AC to DC power transformer 152, a radio frequency receiver 154, a timer element 156, and a solenoid relay 158. The electronics module 150 is coupled to an interior solenoid switch 172, locking assembly 51, 200, and radio frequency transmitter 162.

In this embodiment, the AC to DC power transformer 152 is plugged into a power source such as a standard electrical outlet 153, but it can also be hard wired if desired. Alternative power sources such as a battery may also be used.

The solenoid relay 158 is activated when the radio frequency transmitter 162 sends a signal to the radio frequency receiver 154 or when the interior solenoid switch 172 sends a signal to the electronics module 170. When the solenoid relay 158 is activated, the solenoid 116, 312 is energized. The timer element 156 is coupled to the solenoid relay 158 and allows the solenoid relay 158 to remain activated for a specified time interval, and therefore, allows the operator to open the garage door 10 before the solenoid 116, 312 is deactivated. Generally, the specified time interval can be approximately 5–10 seconds.

The present invention shown in FIGS. 2–4 and 18 operates in the following manner when the garage door 10 is not equipped with a garage door opener. Presuming the garage door 10 is closed and secured, the locking assembly 51 and rod 52 are in the same state as discussed above for present invention operating in conjunction with a garage door opener.

The garage door 10 can be manually opened and unsecured by engaging the interior solenoid switch 172 or radio frequency transmitter 162 (see FIG. 18). The solenoid relay 158 is activated and energizes the solenoid 116. The solenoid 116 retracts its locking pin 118 for the specified time interval. The locking pin 118 pulls the braided wire 120, and the braided wire 120 pulls the latch hook 94 away from its engagement with the secondary gear 80. As the operator manually opens the garage door 10, the rod 52 forces the primary locking gear 57 to rotate to its full counterclockwise position and the secondary gear 80 to its full clockwise position. As the primary locking gear 57 rotates in the counterclockwise direction, the rod 52 is released. The first torsion spring 72 forces the primary locking gear 57 to remain in the full counterclockwise position and the secondary gear 80 to remain in the full clockwise position. When the specified time interval ends, the solenoid 116 is de-energized, the locking pin 118 is extended, the latch hook 94 rotates in a clockwise direction and engages the secondary gear 80. The secondary gear 80 and the primary locking gear 57 is positioned to accept the rod 52.

The garage door 10 can be closed and secured by manually closing the garage door 10. When the operator closes the garage door, the rod 52 begins to engage the U-shaped slot 62 of the primary locking gear 57, thereby causing the primary locking gear 57 to rotate against the force of the torsion spring 72 to its full clockwise position (see FIGS. 2–4). As the primary locking gear 57 rotates, the secondary gear 80 rotates to its full counterclockwise position, and the latch hook 94 is engaged with the secondary gear 80. At this point, the garage door 10 is once again closed and secured.

Referring now to FIGS. 5–16, a second embodiment of the security device 50 is shown. The security device 50 comprises a mounting bracket 202, locking assembly 200, and securing element 201. The mounting bracket 202, which has screw holes 204 and bolt holes 206, can be mounted onto the support frame 15 with screws (not shown) through the screw holes (see FIG. 6). The locking assembly 200 is attached to the mounting bracket 202 by a first 246, second 248, and third bolt 250 and by nuts 251.

The corresponding securing element 201 comprises a base 208, a U-shaped bracket 210, and a rod 212. The securing element 201 is mounted onto the side edge of the garage door 10 by screws (not shown), and the locking assembly 200 engages and disengages with the rod 212.

Figure 7:
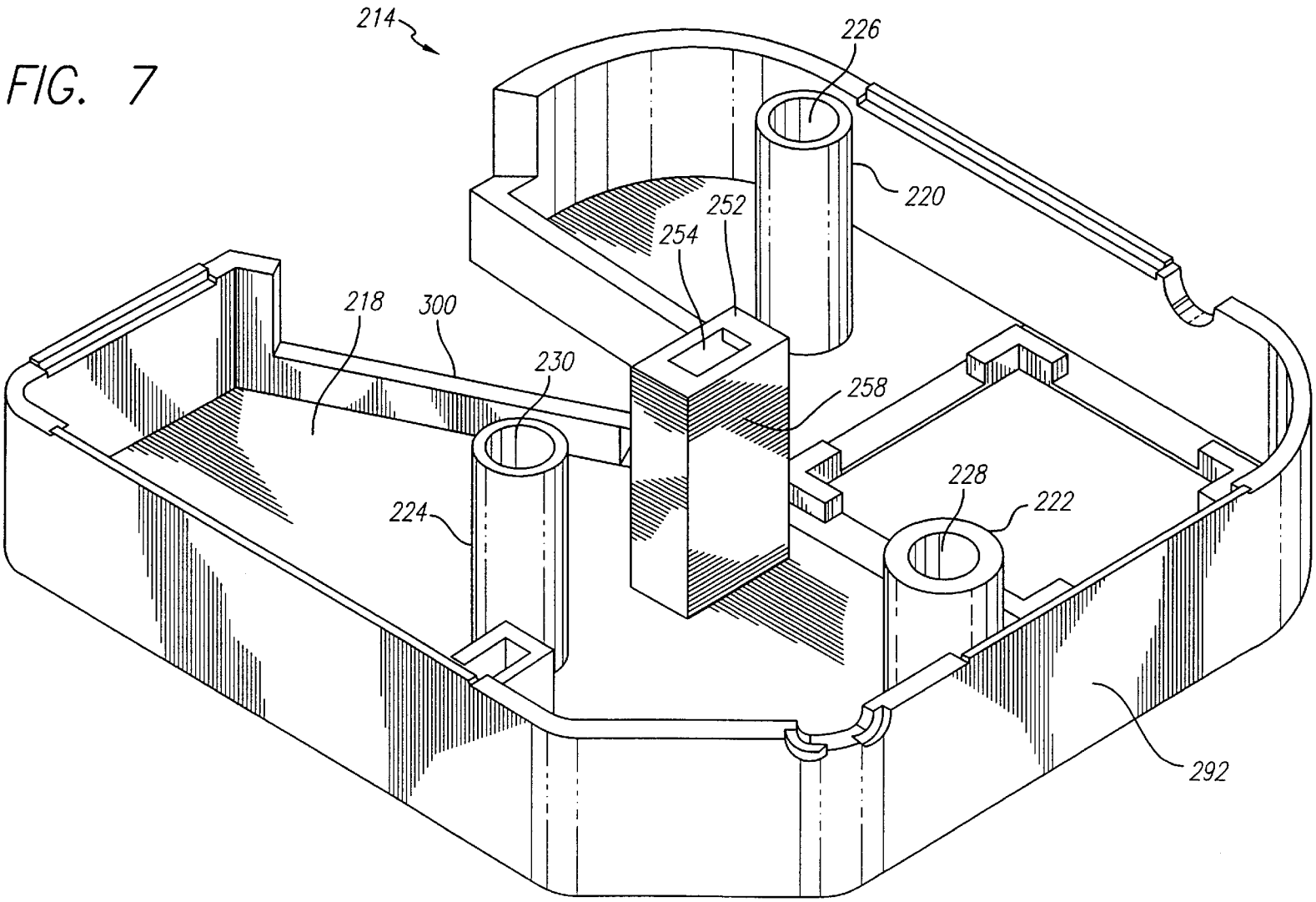
FIG. 7 is a perspective view of the bottom case shown in FIG. 5.
Figure 8:
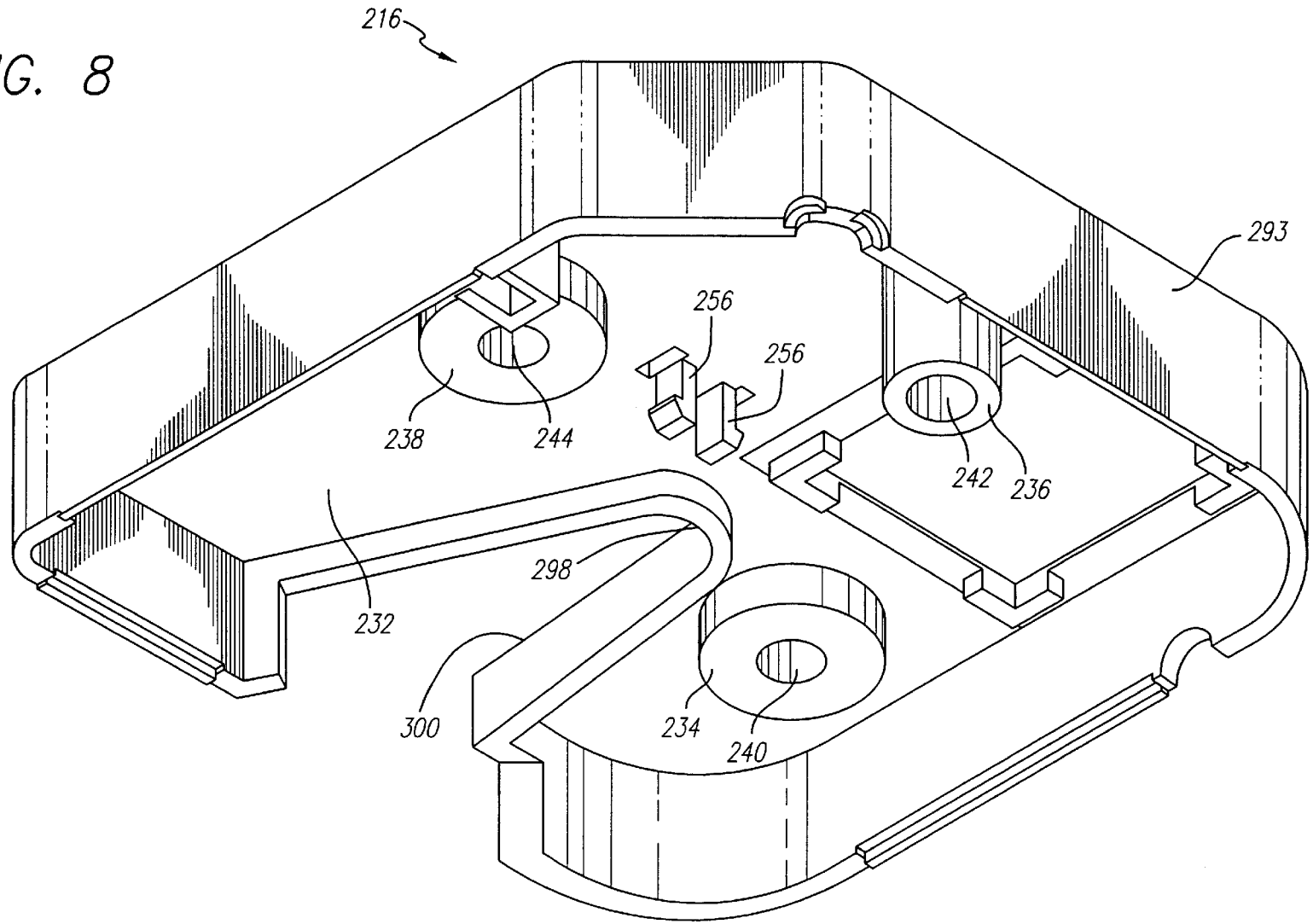
FIG. 8 is a perspective view of the top case shown in FIG. 5.

The mechanism of the locking assembly 200 is housed in a bottom 214 and top case 216 (see FIGS. 7 and 8). The bottom case 214 has a base 218 which includes a first 220, second 222, and third shaft 224. Each of these shafts 220, 222, 224 includes a first 226, second 228, and third hole 230, respectively. The top case 216 has a base 232 which includes a first 234, second 236, and third spacers 238. Each of these spacers 234, 236, 238 includes a first 240, second 242, and third hole 244, respectively. The mounting bracket 202, bottom case 214, and top case 216 are secured together by the first 246, second 248, and third bolt 250 positioned in the holes 206, 226, 228, 230, 240, 242, 246 of the mounting bracket 202, bottom case 214, and top case 216 and secured by the nuts 251. The bottom 214 and top case 216 are also fastened together by a locking latch arrangement. The base 218 of the bottom case 214 has a securing plate 252 with at least one opening 254. The opening 254 is provided to accept locking latches 256 formed on the base 232 of the top case 216. The securing plate 252 preferably has sidewalls 258 to give it depth so that it can accept the locking latches 256.

The locking assembly 200 includes a locking element or lock 260, a latching element or lock arm 262, and a pivoting element or pivot tab 264 (see FIGS. 9–16). The lock 260 is rotatably mounted to the first shaft 220. The lock 260 has a detent which is shown in the drawings as a fork 266, wherein the fork 266 has a U-shaped slot 268 which engages (see FIG. 9) and disengages (see FIG. 11) with the rod 212. The U-shaped slot 268 can have a rectangular, triangular, or any other shape which will engage and disengage with the rod 212. A first 272 and second prong 274, which form the U-shaped slot 268, have a first 276 and second cam surface 278, respectively. In addition, the first 272 and second prong 274 preferably have a first 280 and second contact surface 282, respectively, which are generally flat and located opposite their respective cam surfaces 276, 278. The lock 260 rotates about the first shaft 220 and on the first bearing surface 236 of the top case 216.

Figure 13:
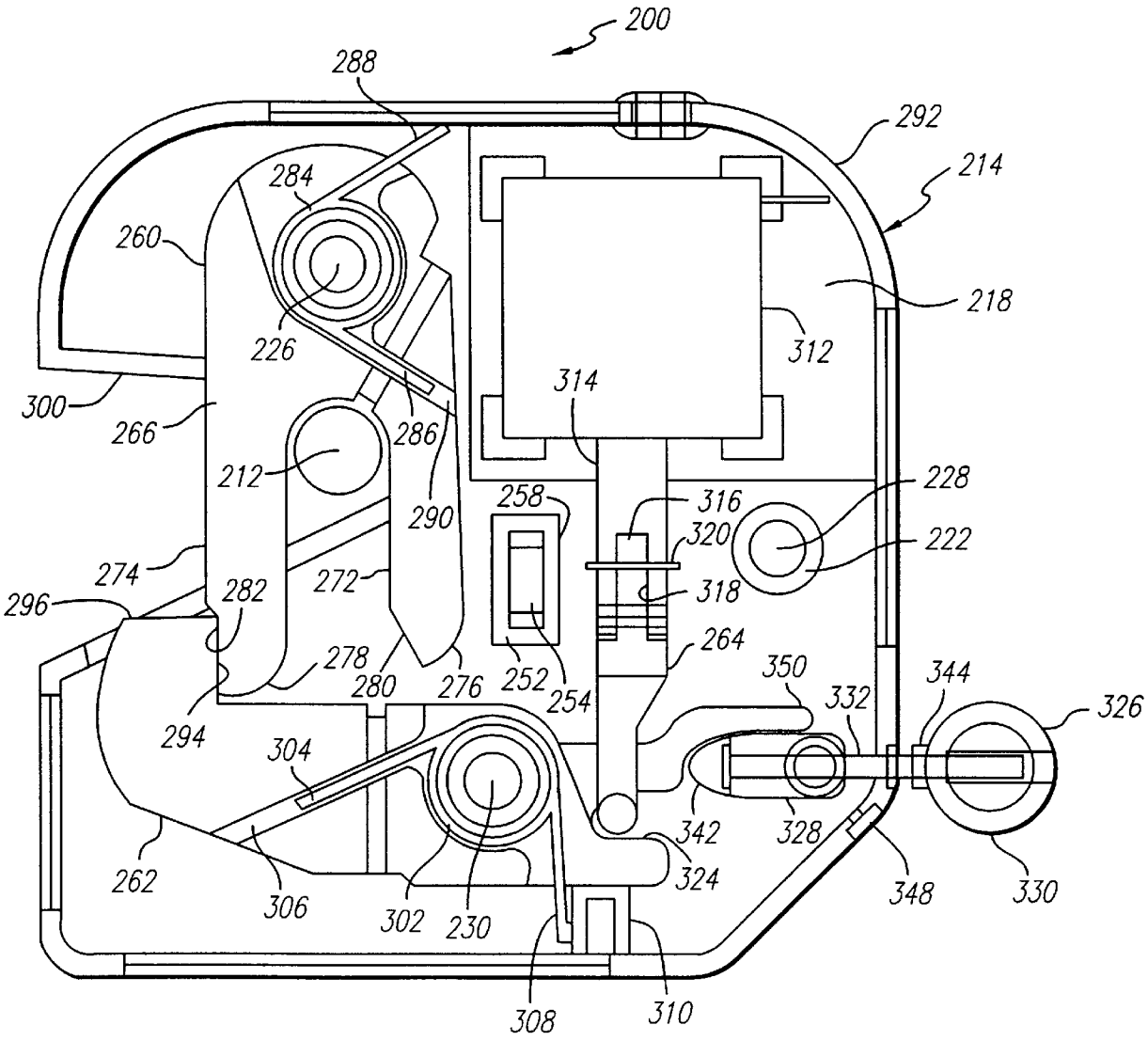
FIG. 13 is a close-up top view of the security device of the embodiment of the present invention shown in FIG. 5 in its secured position being manually unsecured with the manual release handle extended in its secured position.
Figure 14:
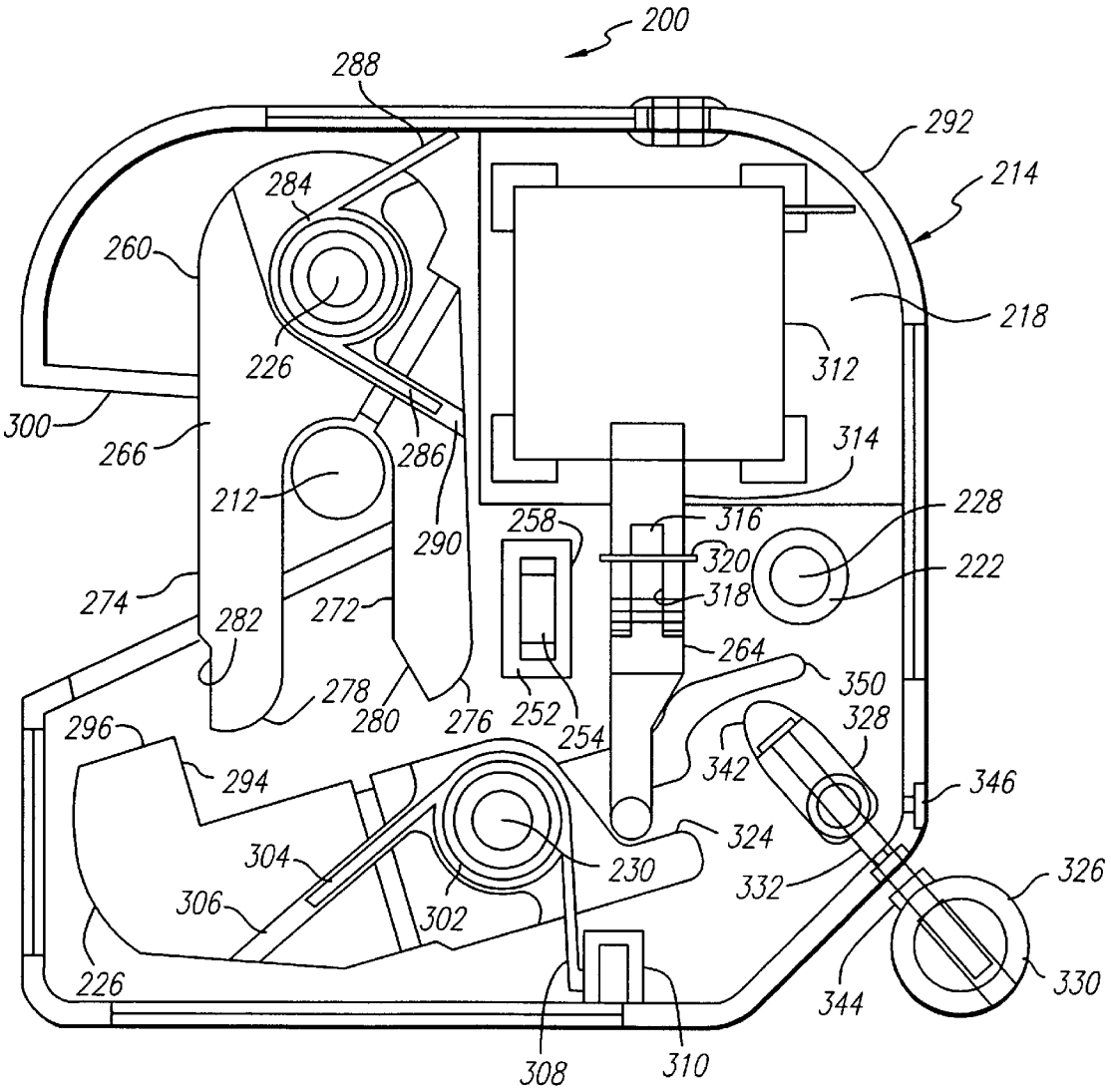
FIG. 14 is a close-up top view of the security device of the embodiment of the present invention shown in FIG. 5 in its unsecured position with the override handle extended in its unsecured position.
Figure 15:
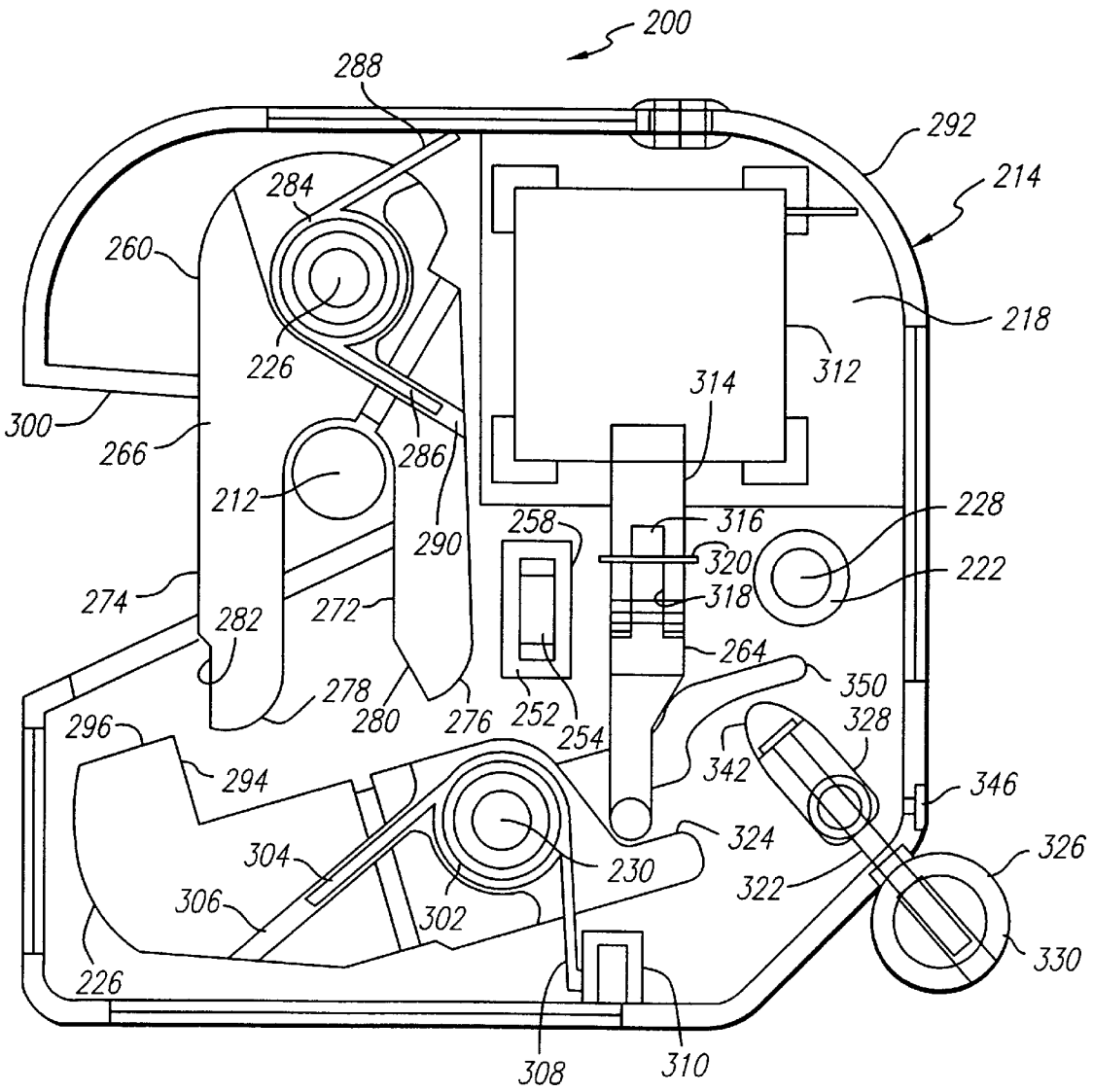
FIG. 15 is a close-up top view of the security device of the embodiment of the present invention shown in FIG. 5 in its unsecured position with the override handle locked in its unsecured position.
Figure 16:
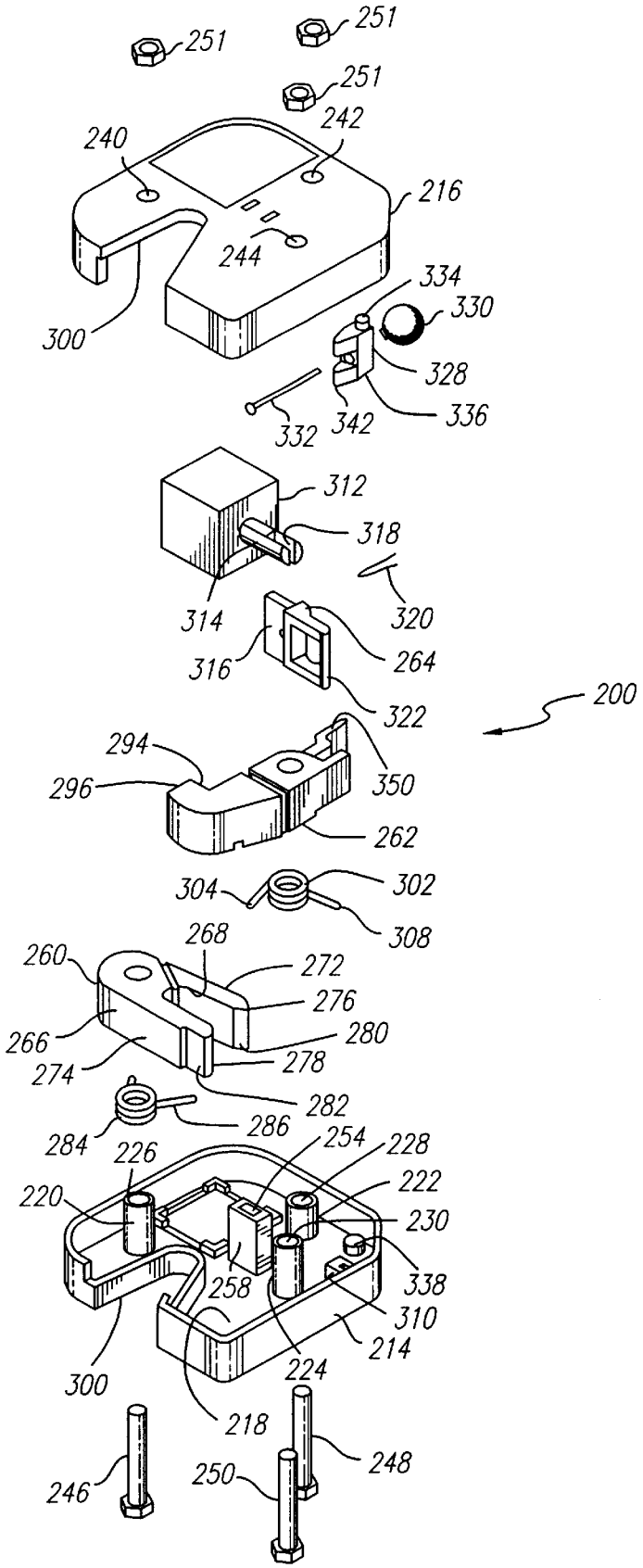
FIG. 16 is an exploded view of the security device of the embodiment of the present invention shown in FIG. 5.

In addition, the lock 260 is urged to rotate in a clockwise direction to its engagement position with the rod 212 by a first torsion spring 284 (see FIG. 13). A first end 286 of the torsion spring 284 is fixedly mounted into a groove 290 formed on the surface of the lock 260, and a second end 288 of the torsion spring 284 bears against a wall 292 of the bottom case 214. The invention is not limited to the torsion spring 260 as shown in the drawings but may be carried out with any other type of mechanism which forces the lock to rotate in one direction.

Figure 9:
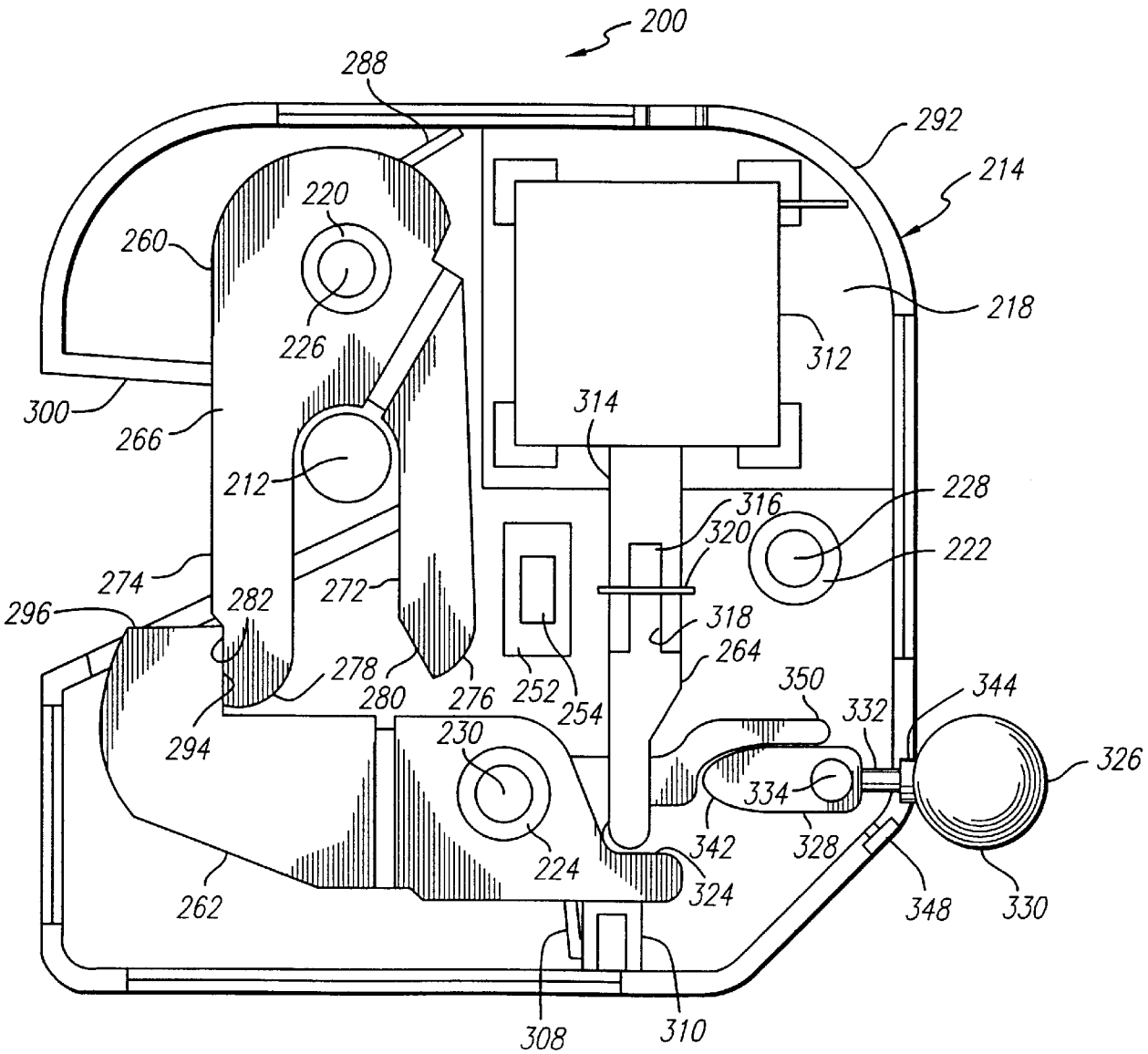
FIG. 9 is a close-up top view of the security device of the embodiment of the present invention shown in FIG. 5 in its secured position with the garage door closed.
Figure 10:
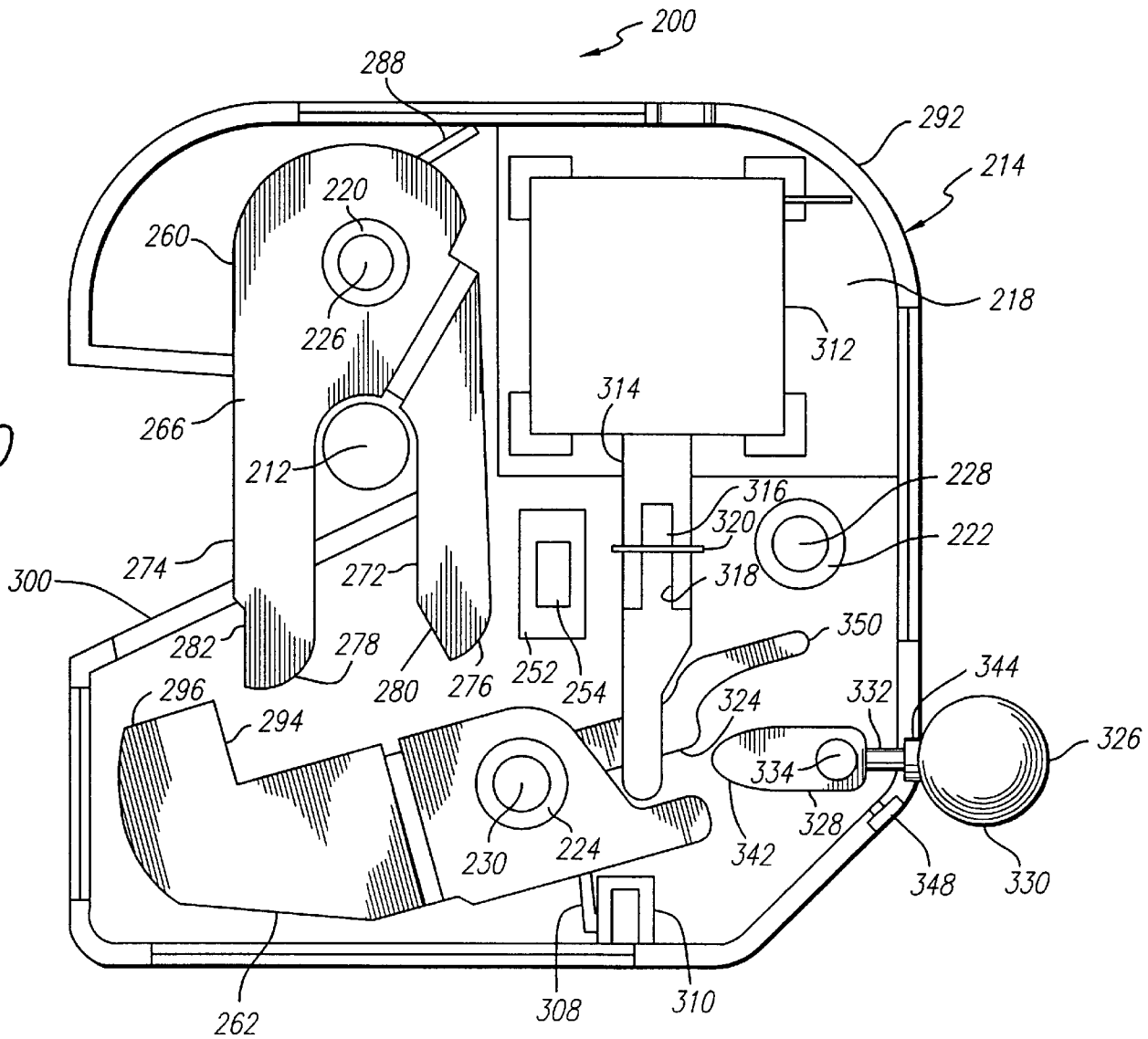
FIG. 10 is a close-up top view of the security device of the embodiment of the present invention shown in FIG. 5 in its unsecured position with the garage door closed and about to be opened.
Figure 11:
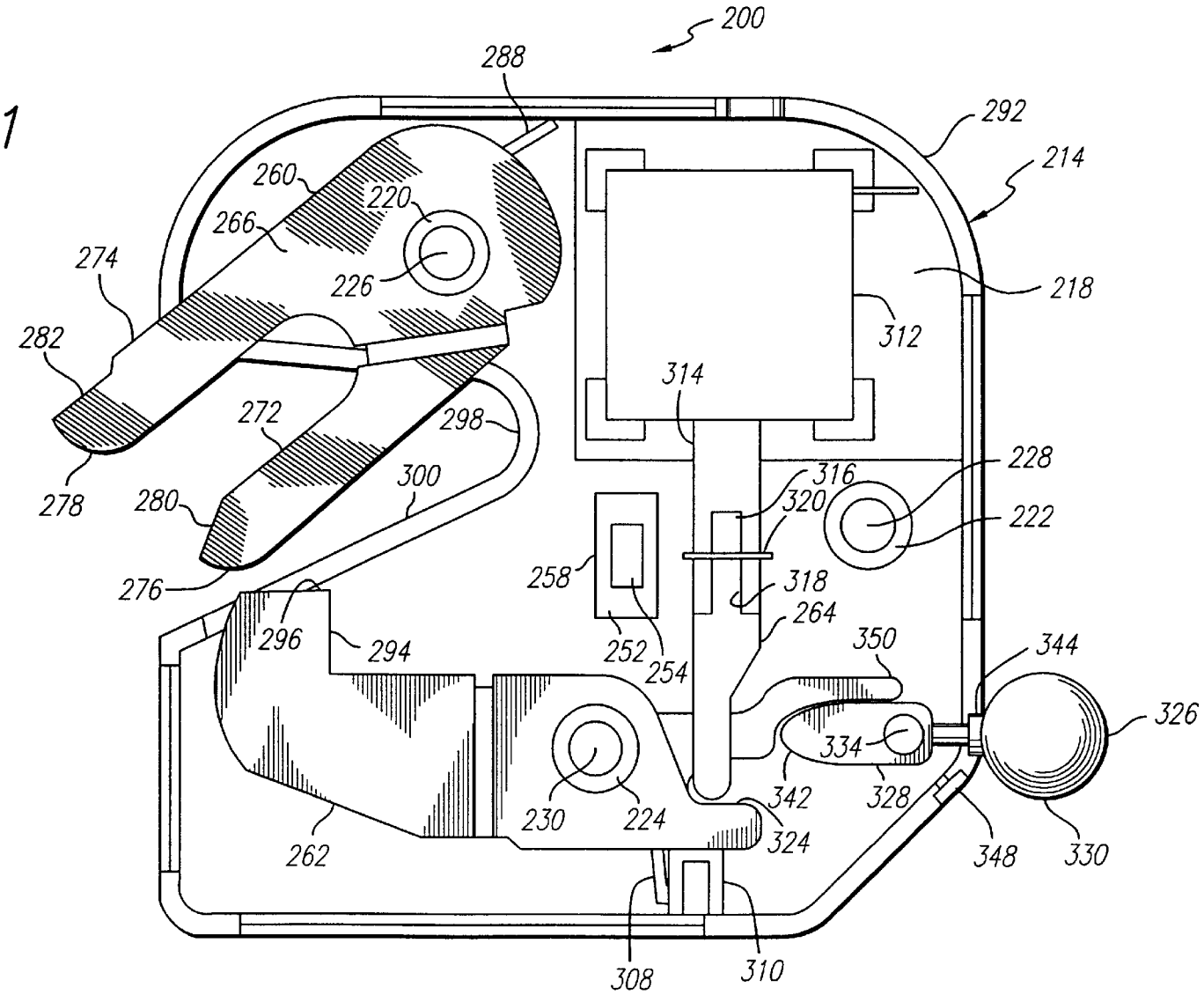
FIG. 11 is a close-up top view of the security device of the embodiment of the present invention shown in FIG. 5 in its secure position with the garage door being opened.
Figure 12:
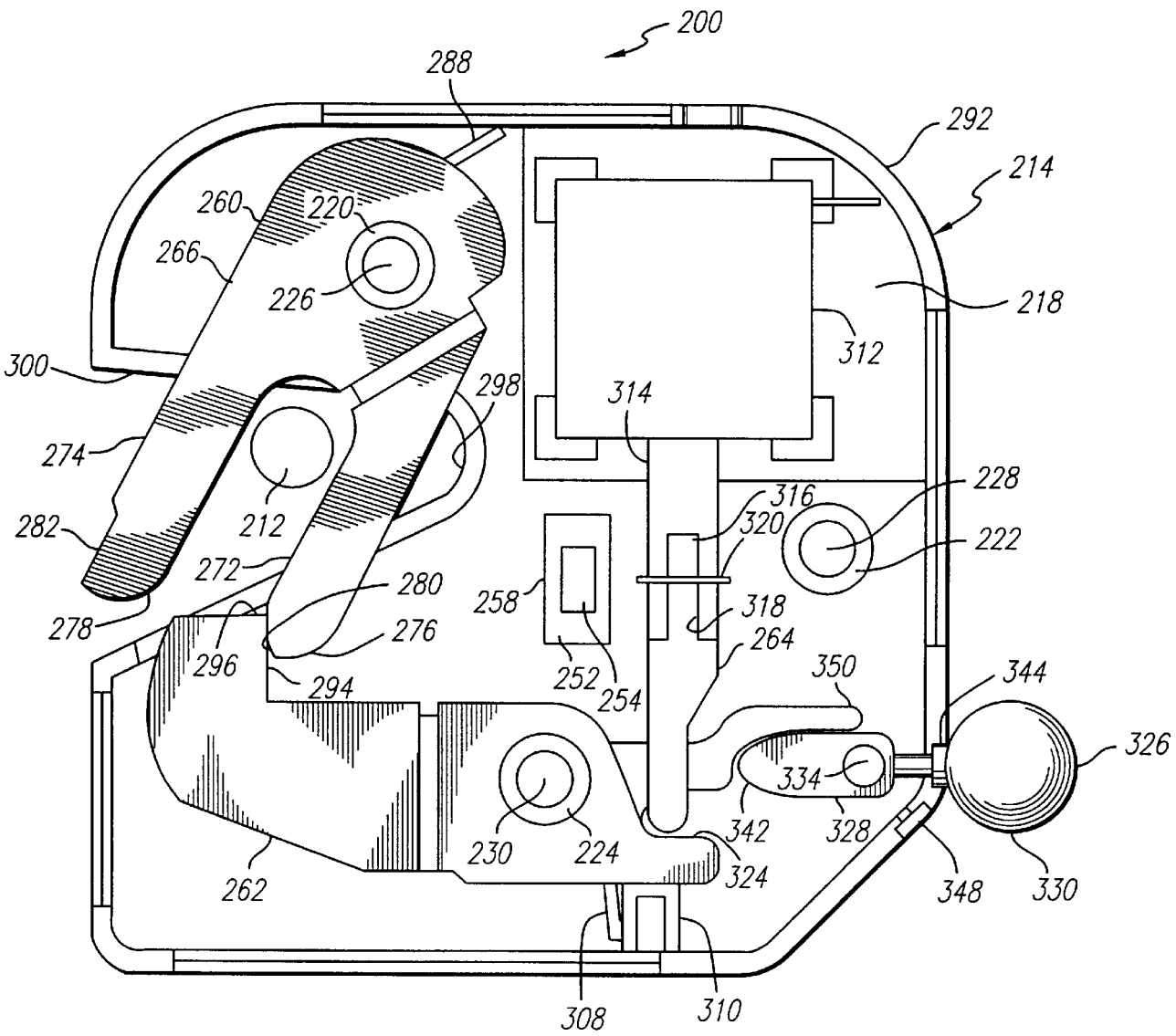
FIG. 12 is a close-up top view of the security device of the embodiment of the present invention shown in FIG. 5 in its secondary secured position with the garage door closed.

The lock arm 262 is rotatably mounted to the third shaft 224 and preferably has a locking surface 294 and a cam surface 296 (see FIGS. 9–16). The locking surface 294 of the lock arm 262 engages (see FIGS. 9 and 12) and disengages (see FIG. 10) with either the first 280 or second contact surface 282 of the lock 260. When the locking surface 294 is engaged with the lock 260 (as shown in FIGS. 9 and 12) the lock 260 is restricted from rotating in the clockwise direction, but it is free to rotate in a counterclockwise direction until it stopped by the rod 212 abutting against a vertex 298 of a V-shaped slot 300 formed in the base 218, 232 of the bottom 214 and top case 216.

The lock arm 262 is urged to rotate in a clockwise direction to its engagement position with the lock 260 (see FIG. 13) by a second torsion spring 302 having a first end 304 fixedly mounted into a groove 306 formed on the surface of the locking arm 262, and a second end 308 of the torsion spring 302 bears against a pedestal 310 located on the base 218 and wall 292 of the bottom case 214. The lock arm 262 is able to rotate in the clockwise direction until it is stopped by the lock arm 262 abutting against the pedestal 310 of the bottom case 214. Again, the invention is not limited to the torsion spring 302, but can be carried out with any other type of spring or mechanism for forcing the lock arm 262 to rotate in a clockwise direction.

An actuator, which is mounted on the base 218 of the bottom case 214, causes the lock arm 262 to engage and disengage with the lock 260 (see FIGS. 9–16). In one embodiment of the present invention, the actuator is a solenoid 312 having a locking pin 314. The locking pin 314 is extended (see FIGS. 9 and 11–12) when the solenoid 312 is de-energized and retracted (see FIG. 10) when the solenoid 312 is energized. The actuator may be any electronic solenoid, as shown in the drawings, or other device known in the art for selectively moving a locking pin 314 or other element to and from an extended to a retracted position.

The solenoid 312 is coupled to the lock arm 262 by the pivot tab 264 (see FIGS. 9–16). The pivot tab 264 has a rectangular shaped member 316 on one end which fits into a slit 318 of the locking pin 314 and is secured to the locking pin 314 by a cotter pin 320. The pivot tab 264 has a rod 322 at the other end, and the rod 322 is pivotally coupled to a U-shaped slot 324 located on the lock arm 262 at the end opposite the locking 294 and cam surfaces 296.

Usually, the solenoid 312 is de-energized, the locking pin 314 is extended, and the lock arm 262 is engaged with the second contact surface 282 of the lock 260 (see FIG. 9). When the solenoid 312 is energized, the locking pin 314 is retracted, the pivot tab 264 pulls the lock arm 262, and the lock arm 262 rotates in the counterclockwise direction and disengages with the lock 260.

A manual release member 326 includes a release tab 328, spherical knob 330, and bolt 332 (see FIGS. 5–11). The release tab 328 has a first 334 and second stud 336. The first 334 and second stud 336 fit into and rotate about a first 338 and second recess (not shown) formed in the bottom 214 and top case 216, respectively. The release tab 328 has a cam tip 342 on one end. The bolt 332 is positioned longitudinally through the release tab 328, and the spherical knob 330 is attached to the bolt 332 at the end opposite the cam tip 342. The spherical knob 330 has a flange 344 which fits into a first 346 or second recess 348 formed in the walls 292, 293 of the bottom 214 and top case 216. When the flange 344 is positioned in the first recess 346, the manual release member 326 is set at the secured position. The release tab 328 is positioned parallel to a flap 350 extending from the lock arm 262, and the lock arm 262 is engaged with the lock 260 (see FIG. 9). As the flange 344 is pulled out of the first recess 346 and positioned towards the second recess 348, the cam tip 342 slides along the flap 350 and causes the lock arm 262 to rotate in a counterclockwise direction (see FIGS. 13 and 14). When the flange 344 is positioned in the second recess 348, the manual release member 326 is set at the unsecured position. The cam tip 342 rotates the lock arm 262 to the full counterclockwise position such that the lock arm 262 is disengaged with the lock 260 (see FIG. 15).

The bottom case 214, top case 216, lock 260, lock arm 262, pivot tab 264, and release tab 328 are formed from an injection molded nylon. However, other plastics and metals having adequate strength and reliability may be used. The lock 260 and lock arm 262 may be further strengthened by having them formed in a multilayer configuration.

The present invention shown in FIGS. 5–13 and 17 operates in the following manner when the garage door 10 is equipped with a garage door opener 30. Assuming the garage door 10 is closed and secured, the rod 212 is engaged in the U-shaped slot 268 of the lock 260, the lock 260 is rotated to its full counterclockwise position, and the lock arm 262 is rotated to its full clockwise position and is engaged with the lock 260. The solenoid 312 is de-energized and the locking pin 314 is extended.

The garage door 10 can be opened and unsecured by an operator energizing the solenoid 312 by engaging the garage door opener button 46 or the radio frequency transmitter 162 (see FIGS. 5–13 and 17). The electronics module 150 activates the solenoid relay 158, and the solenoid 312 is energized and retracts its locking pin 314 for the specified time interval. The locking pin 314 pulls the pivot tab 264, and the pivot tab 264 pulls the lock arm 262. The electric motor 44 for the garage door opener 30 is energized simultaneously with solenoid 312, and the garage door 10 is carried towards a horizontal open position. As the garage door 10 is opening, the rod 212 forces the lock 260 to rotate to its full clockwise position. As the lock 260 rotates in the clockwise direction the rod 212 is released.

The electric motor 44 for the garage door opener 30 automatically stops when the garage door 10 is carried to the horizontal open position. The first torsion spring 284 forces the lock 260 to remain in the full clockwise position. When the specified time interval ends, the solenoid 312 is de-energized. The second torsion spring 302 causes the lock arm 262 to rotate in the clockwise direction and towards its engagement position with the lock 260, and the locking pin 314 is extended. The lock 260 remains stationary, wherein the lock 260 is positioned to accept the rod 212.

The garage door 10 can be closed and secured by the operator activating the solenoid 312 by engaging the garage door opener button 46 or radio frequency transmitter 162 (see FIGS. 5–16 and 17). The electronics module 150 activates the electric motor relay 160, and the electric motor 44 is energized and lowers the garage door 10 downwardly to a vertical closed position where the electric motor 44 automatically stops. As the rod 212 engages with the U-shaped slot 268 of the lock 260, the lock 260 is rotated in a counterclockwise position against the force of the first torsion spring 284, and the cam surface 296 of the lock arm 262 slides along the first 276 and second cam surface 278 of the lock 260. The garage door 10 is once again closed and secured when the rod 212 is engaged in the U-shaped slot 268 of the lock 260, the lock 260 is rotated to its full counterclockwise position, and the lock arm 262 is rotated to its clockwise position, and the second contact surface 282 of the lock 260 is engaged with the locking surface 294 of the locking arm 262.

In the event that the garage door 10 is not fully closed, the garage door 10 may be adequately secured in a secondary secured position if the garage door 10 is lowered to an extent where the rod 212 engages with the U-shaped slot 268 of the lock 260, the lock 260 is rotated in a counterclockwise direction such that the first cam surface 276 of the lock 260 slides along the cam surface 296 of the lock arm 262, and the first contact surface 280 of the lock 260 engages with the locking surface 294 of the lock arm 262.

The present invention shown in FIGS. 5–13 and 18 operates in the following manner when it is not equipped with a garage door opener. Presuming the garage door 10 is closed and secured, the locking assembly 200 and rod 212 are in the same state as discussed above for this embodiment operating in conjunction with a garage door opener.

The garage door 10 can be manually opened and unsecured by an operator activating the solenoid 312 by engaging the interior solenoid switch 172 or the radio frequency transmitter 162 (see FIGS. 5–16 and 18). The electronics module 150 activates the solenoid relay 158, wherein the solenoid 312 is energized and retracts its locking pin 314 for a specified time period. The locking pin 314 pulls the pivot tab 264, and the pivot tab 264 pulls the lock arm 262 away from its engagement with the lock 260. As the operator manually opens the garage door 10, the rod 212 forces the lock 260 to rotate to its full clockwise position. As the lock 260 rotates in the clockwise direction, the rod 212 is released. The first torsion spring 284 forces the lock 260 to remain in the full clockwise position. When the specified time interval ends, the solenoid 312 is de-energized, the lock arm 262 rotates to its full clockwise position, and the locking pin 314 is extended. The lock 260 remains stationary, and is positioned to accept the rod 212.

The garage door 10 can be closed and secured by manually closing the garage door 10 (see FIGS. 5–13). When the operator closes the garage door 10, the rod 212 begins to engage the U-shaped slot 268 of the lock 260, thereby causing the lock 260 to rotate in a counterclockwise direction against the force of the first torsion spring 284, and the cam surface 296 of the lock arm 262 slides along the first 276 and second cam surface 278 of the lock 260. The garage door 10 is once again closed and secured when the rod 212 is engaged in the U-shaped slot 268 of the lock 260, the lock 260 is rotated to its full counterclockwise position, and the lock arm 262 is rotated to its clockwise position and engaged with the lock 260.

Figure 19:
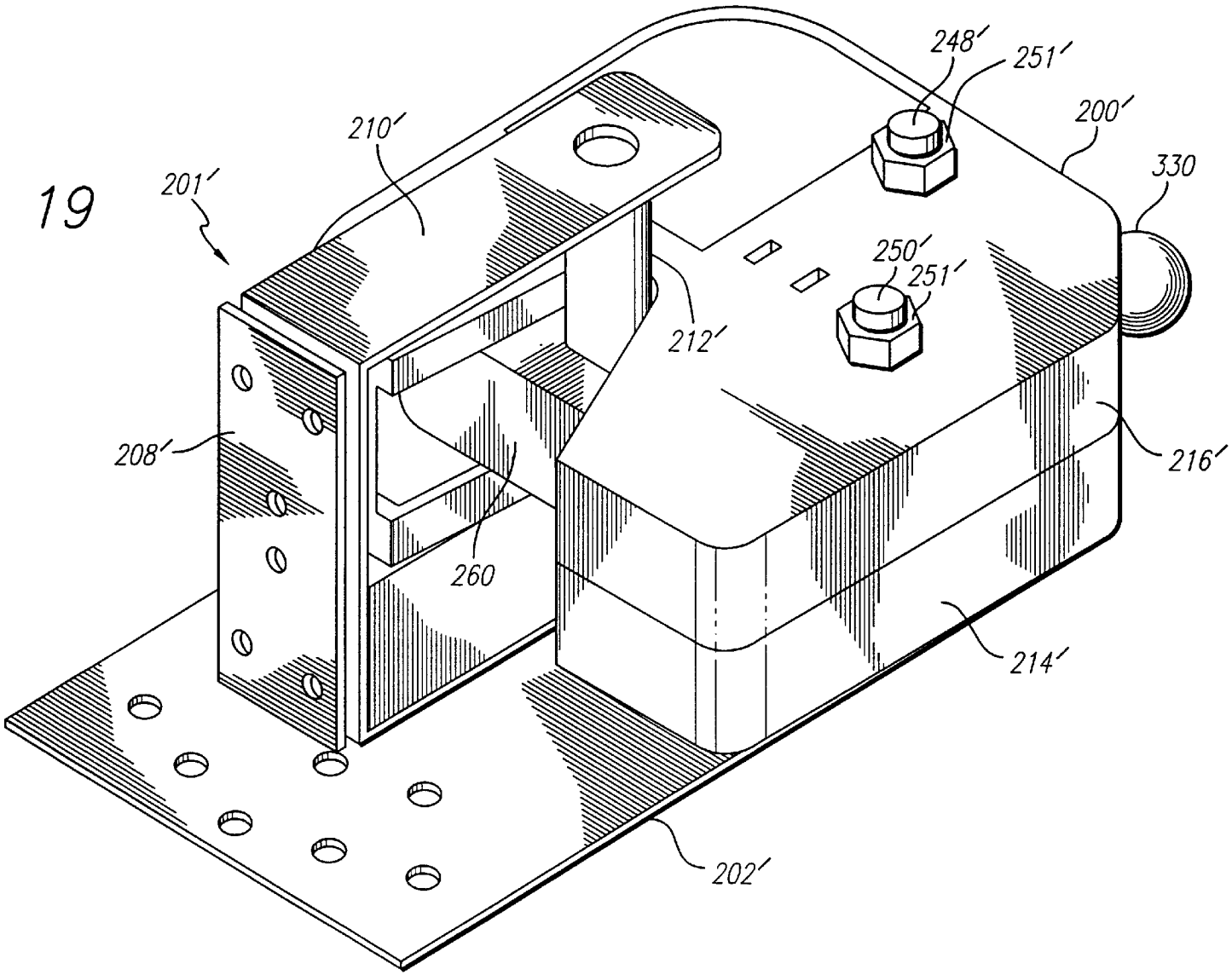
FIG. 19 is a perspective view of another alternative embodiment of the security device in its secured position with the garage door closed.
Figure 20:
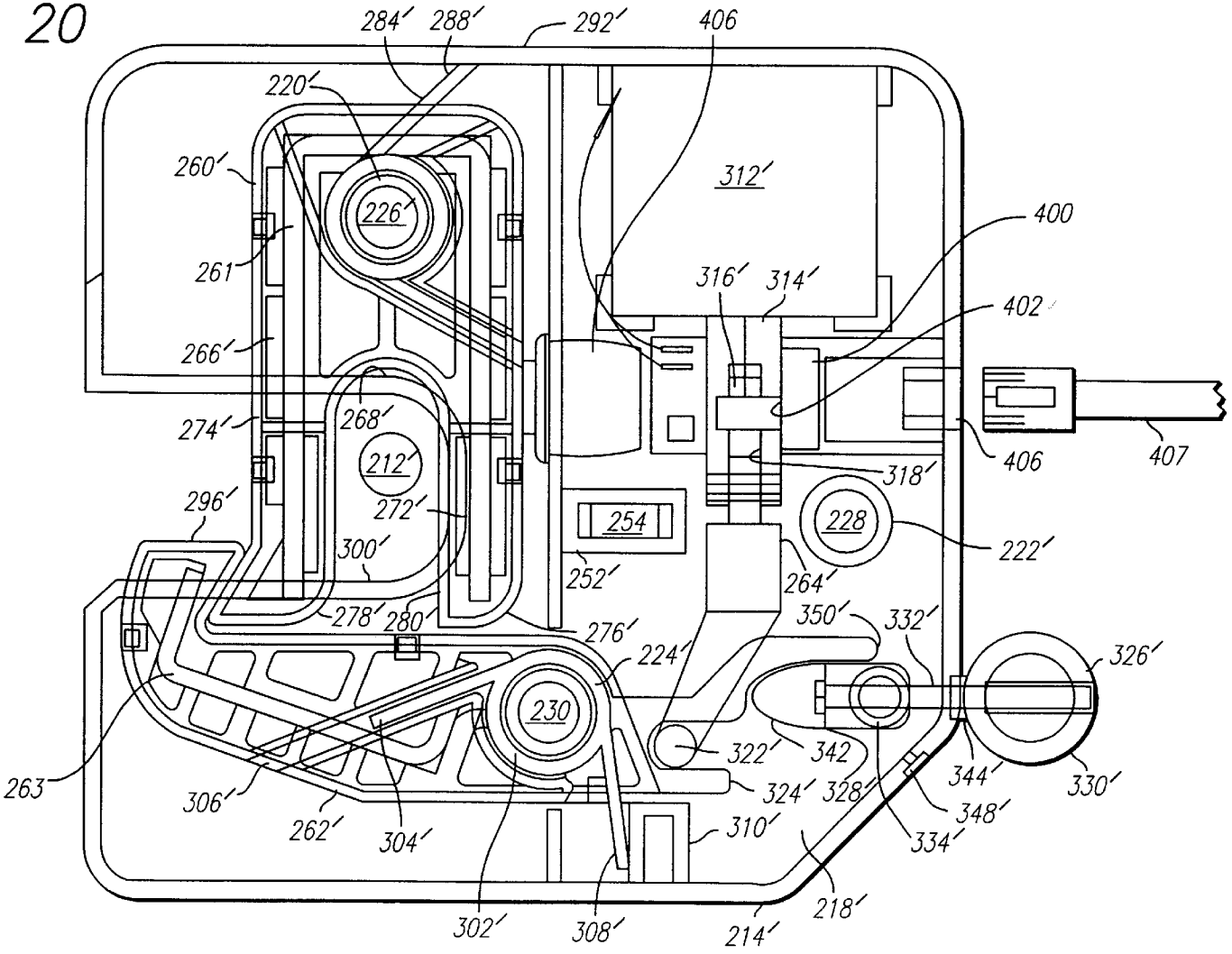
FIG. 20 is a close-up top view of the security device of the embodiment of the present invention shown in FIG. 19 in its secured position with the garage door closed.
Figure 21:
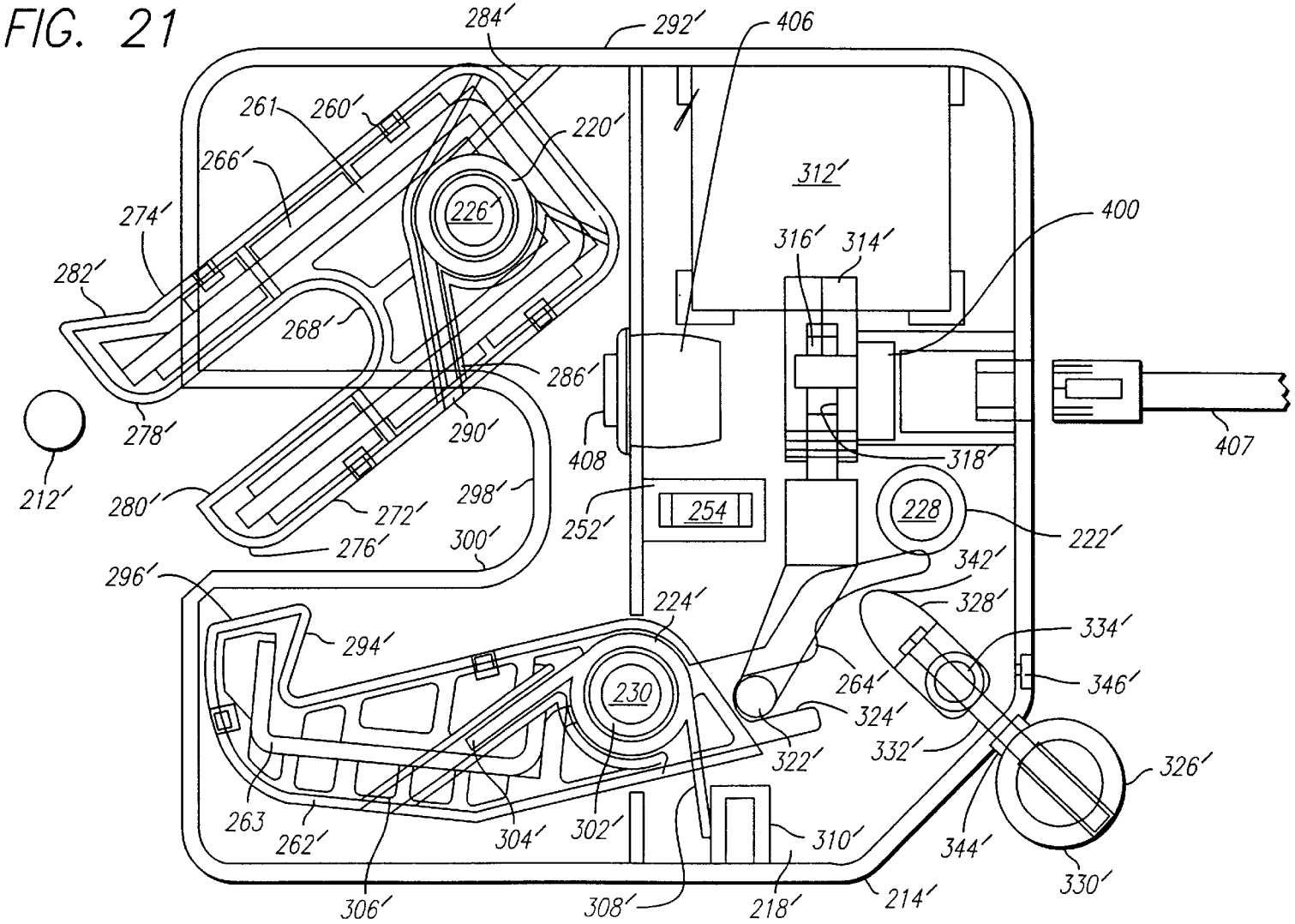
FIG. 21 is a close-up top view of the security device of the embodiment of the present invention shown in FIG. 19 in its unsecured position with the garage door opened.

Referring to FIGS. 19–21, a third embodiment of the security device 50 is shown. The third embodiment of the security device 50 is similar to the previous embodiment with the exception that the various components are modified to incorporate position sensors into the locking assembly for determining the status of the locking assembly. Thus, like components are numbered with the same number and with a prime.

The security device 50 comprises a mounting bracket 202', locking assembly 200', and securing element 201'. The mounting bracket 202' can be mounted onto the support frame 15 with screws, and the locking assembly 200' is attached to the mounting bracket 202' by bolts and nuts.

The corresponding securing element 201' comprises a base 208', a U-shaped bracket 210', and a rod 212'. The securing element 201' is mounted onto the side edge of the garage door 10 by screws (not shown), and the locking assembly 200' engages and disengages with the rod 212'.

The mechanism of the locking assembly 200' is housed in a bottom 214' and top case 216' (see FIGS. 19–21). The bottom case 214' has a base 218' which includes a first 220', second 222', and third shaft 224'. Each of these shafts 220', 222', 224' includes a first 226', second 228', and third hole 230', respectively. The top case 216' includes a first 240', second 242', and third hole 244', respectively. The mounting bracket 202', bottom case 214', and top case 216' are secured together by the first (not shown), second 248', and third bolt 250' positioned in the holes of the mounting bracket 202', bottom case 214', and top case 216' and secured by the nuts 251'. The bottom 214' and top case 16' are also fastened together by a locking latch arrangement. The base 218' of the bottom case 214' has a securing plate 252' with at least one opening 254'. The opening 254' is provided to accept a locking latch (not shown) formed on the base 232' of the top case 216'. The locking assembly 200' includes a locking element or lock 260', a latching element or lock arm 262', and a pivoting element or pivot tab 264' (see FIGS. 19–21). The lock 260' is rotatably mounted to the first shaft 220'. The lock 260' has a detent which is shown in the drawings as a fork 266', wherein the fork 266' has a U-shaped slot 268' which engages and disengages with the rod 212'. The U-shaped slot 268' can have a rectangular, triangular, or another other shape which will engage and disengage with the rod 212'. A first 272' and second prong 274', which form the U-shaped slot 268', have a first 276' and second cam surface 278', respectively. In addition, the first 272' and second prong 274' preferably have a first 280' and second contact surface 282', respectively, which are generally flat and located opposite their respective cam surfaces 276', 278'. The lock 260' rotates about the first shaft 220'.

The lock 260' rotates about the first shaft 220' and is urged to rotate in a clockwise direction to its engagement position with the rod 212' by a first torsion spring 284' (see FIGS. 20 and 21). A first end of the torsion spring 286' is fixedly mounted into a groove 290' formed on the surface of the lock 260', and a second end 288' of the torsion spring 284' bears against a wall 292' of the bottom case 214. The invention is not limited to the torsion spring 260' as shown in the drawings but may be carried out with any other type of mechanism which forces the lock to rotate in one direction.

The lock arm 262' is rotatably mounted to the third shaft 224' and preferably has a locking surface 294' and a cam surface 296' (see FIGS. 20 and 21) . The locking surface 294' of the lock arm 262' engages and disengages with either the first 280' or second contact surface 282' of the lock 260'. When the locking surface 294' is engaged with the lock 260' (as shown in FIG. 20) the lock 260' is restricted from rotating in the clockwise direction, but it is free to rotate in a counterclockwise direction until it is stopped by the rod 212' abutting against a vertex 298' of the U-shaped slot 300' formed in the base 218' of the bottom case 216'. It is noted that the contact surface 282' of the lock 260' is angled obtusely with the body of the lock 260', and the locking surface 294' is angled acutely with the body of the lock arm 262' to reduce the likelihood of the locking surface 294' being forcibly disengaged from second contact surface 282' such as during an unauthorized forced entry of the garage door 10.

The lock arm 262' is urged to rotate in a clockwise direction to its engagement position with the lock 260' (see FIG. 20) by a second torsion spring 302' having a first end 304' fixedly mounted into a groove 306' formed on the surface of the locking arm 262', and a second end 308' of the torsion spring 302' bears against a pedestal 310' located on the base 218' and wall 292' of the bottom case 214'. The lock arm 262' is able to rotate in the clockwise direction until it is stopped by the lock arm 262' abutting against the pedestal 310' of the bottom case 214'. Again, the invention is not limited to the torsion spring 302', but can be carried out with any other type of spring or mechanism for forcing the lock arm 262' to rotate in a clockwise direction.

An actuator, which is mounted on the base 218' of the bottom case 214, causes the lock arm 262' to engage and disengage with the lock 260' (see FIGS. 20 and 21). In one embodiment of the present invention, the actuator is a solenoid 312' having a locking pin 314'. The locking pin 314' is extended (see FIG. 20) when the solenoid 312' is de-energized and retracted (see FIG. 21) when the solenoid 312' is energized. The actuator may be any electronic solenoid, as shown in the drawings, or other device known in the art for selectively moving a locking pin 314' or other element to and from an extended to a retracted position.

The solenoid 312' is coupled to the lock arm 262' by the pivot tab 264' (see FIGS. 20 and 21). The pivot tab 264' has a rectangular shaped member 316' on one end which fits into a slit 318' of the locking pin 314' and is secured to the locking pin 314' by a cotter pin. The pivot tab 264' has a rod 322' at the other end, and the rod 322' is pivotally coupled to a U-shaped slot 324' located on the lock arm 262' at the end opposite the locking 294' and cam surfaces 296'.

Usually, the solenoid 312' is de-energized, the locking pin 314' is extended, and the lock arm 262' is engaged with the second contact surface 282' of the lock 260' (see FIG. 20). When the solenoid 312' is energized, the locking pin 314' is retracted, the pivot tab 264' pulls the lock arm 262', and the lock arm 262' rotates in the counterclockwise direction and disengages with the lock 260'.

A manual release member 326' includes a release tab 328', spherical knob 330', and bolt 332' (see FIGS. 20 and 21). The release tab 328' has a first 334' and second stud (not shown). The first 334' and second stud fit into and rotate about recesses (not shown) formed in the bottom 214' and top case 216'. The release tab 328' has a cam tip 342' on one end. The bolt 332' is positioned longitudinally through the release tab 328', and the spherical knob 330' is attached to the bolt 332' at the end opposite the cam tip 342'. The spherical knob 330' has a flange 344' which fits into a first 346' or second recess 348' formed in the walls 292', 293' of the bottom 214' and top case 216'. When the flange 344' is positioned in the first recess 346', the manual release member 326' is set at the secured position. The release tab 328' is positioned parallel to a flap 350' extending from the lock arm 262',and the lock arm 262' is engaged with the lock 260' (see FIG. 20) . As the flange 344' is pulled out of the first recess 346' and positioned towards the second recess 348', the cam tip 342' slides along the flap 350' and causes the lock arm 262' to rotate in a counterclockwise direction (see FIG. 21). When the flange 344' is positioned in the second recess 348',the manual release member 326' is set at the unsecured position. The cam tip 342' rotates the lock arm 262' to the full counterclockwise position such that the lock arm 262' is disengaged with the lock 260' (see FIG. 21).

The bottom case 214', top case 216', lock 260', lock arm 262', pivot tab 264', and release tab 328' are formed from ABS or Delron, However, other plastics and metals having adequate strength and reliability may be used. In the embodiment illustrated in FIGS. 20 and 21, the lock 260' and lock arm 262' are further strengthened by a first 262 and second metal insert 263, respectively.

A lock arm sensor, which is mounted on the base 218' of the bottom case 214' and adjacent to the pivot tab 264',is coupled to the pivot tab 264' to enable the security system to determine whether the lock arm 262' is in the engaged or disengaged position (see FIGS. 20 and 21). In one embodiment of the present invention, the lock arm sensor is a double pole/double throw (dp/dt) switch 400 having a movable pin 402 connected to the rectangular shaped member 316' of the pivot tab 264' such that the switch 400 is "on" when the solenoid 312' is energized, the locking pin 314' is retracted, the pivot tab 264' is retracted, and the lock arm 262' is in the disengaged position. The switch 400 is "off" when the solenoid 312' is de-energized, the locking pin 314' is extended, the pivot tab 264' is extended, and the lock arm 262' is in the engaged position. The switch 400 is interconnected to a telephone jack connector 406 disposed within the locking assembly 200', and the telephone jack connector 406 is connected to the security system by a connecting wire 407 such as a six conductor phone cord.

A lock sensor, which is mounted on the base 218' of the bottom case 214' and adjacent to the lock 260', is coupled to the lock 260' to enable the security system to determine whether the lock 260' is in the secured or unsecured position (see FIGS. 20 and 21). In one embodiment of the present invention, the lock sensor is a single pole/single throw (sp/st) switch 406 having a retractable pin 408 which engages with the lock 260' when the lock 260' is in the secured position. The switch 404 is "on" when the lock 260' is in the secured position and "off" when the lock 260' is in the unsecured position. The additional switch 404 is interconnected to the telephone jack connector 406, and further interconnected to the security system by the six conductor phone cord.

Figure 22:
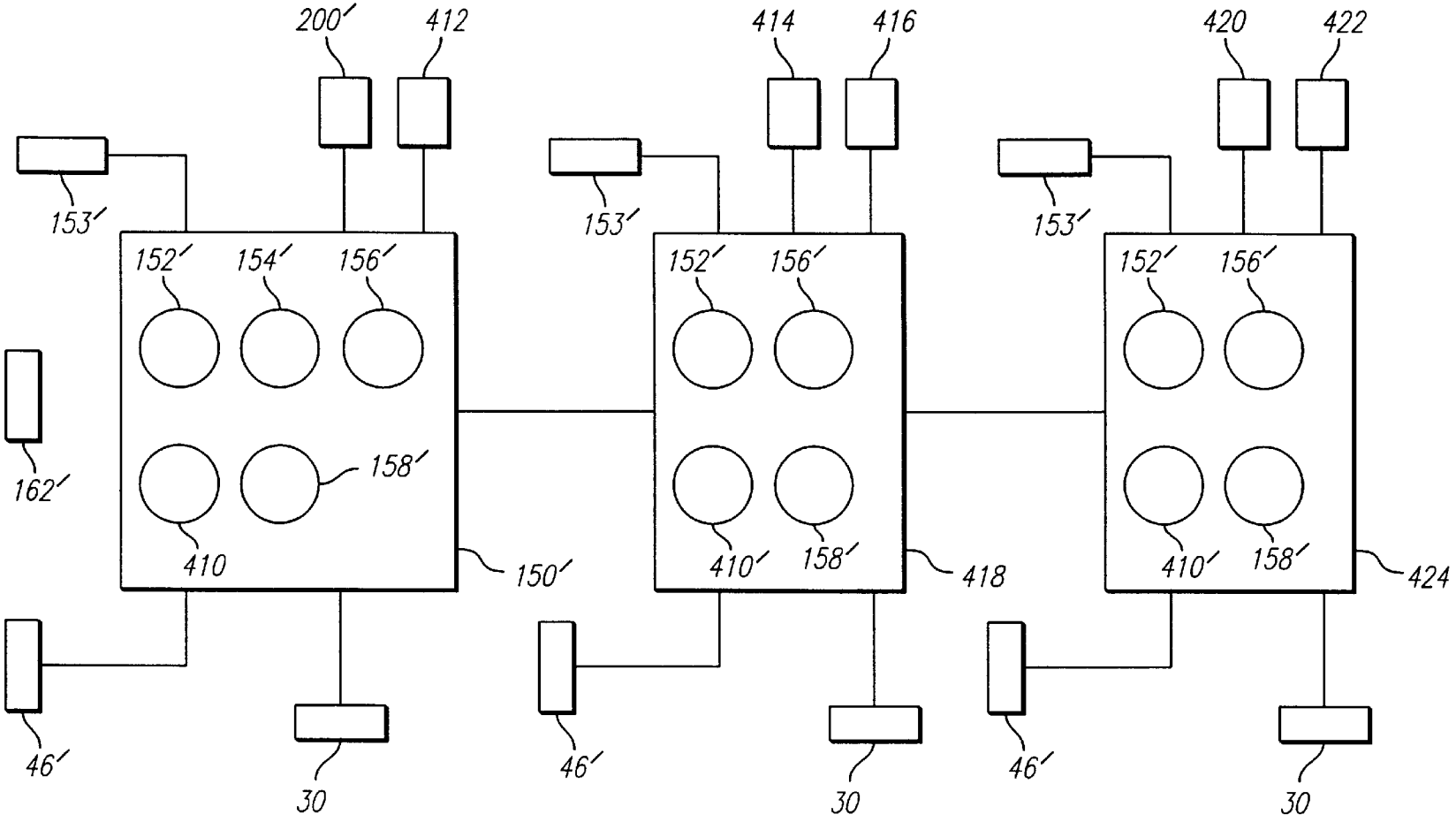
FIG. 22 is a block diagram of the electronics which controls the security device illustrated in FIG. 19 for a garage door equipped with a garage door opener.

FIG. 22 is a block diagram of a preferred embodiment of the electronics which control the third embodiment of the security device 50 described for a garage door 10 equipped with a garage door opener 30. The electronics module 150' includes an AC to DC power transformer 152', a radio frequency receiver 154', a timer element 156', a garage door opener relay 410, and a solenoid relay 158'. The electronics module 150' is coupled to the garage door opener 30', a garage door opener button 46', the locking assembly 200', and the radio frequency transmitter 162'. The AC to DC power transformer 152' is connected to a power supply such as a standard electrical outlet 153' or the light bulb socket of the garage door opener 30. Alternative power sources such as a battery may also be used.

The preferred embodiment may further include a second locking assembly 412 which can be mounted on the support frame 15 to further secure the garage door 10. The second locking assembly 412 is essentially the same as the locking assembly 200 described above.

A second garage door (not shown) may be secured by a third locking assembly 414 and/or a fourth locking assembly 416, wherein the third 414 and/or fourth locking assembly 416 are controlled by a first auxiliary electronics module 418 (see FIG. 22). In addition, a third garage door (not shown) may be secured by a fifth 420 and/or sixth locking assembly 422, wherein the fifth 420 and sixth locking assembly 422 are controlled by a second auxiliary electronics module 424. The first auxiliary electronics module 418 is interconnected with the electronics module 150', and the second auxiliary electronics module 424 is interconnected with the first auxiliary module 424 such that the electronic modules 150', 418, 424 are connected in a daisy-like fashion. It is noted that both the first 418 and second auxiliary electronics module 424 may be directly connected to the electronics module 150'.

The third 414, fourth 416, fifth 420 and sixth locking assembly 422 are essentially the same as the first locking assembly 200' described above, and the first 418 and second auxiliary electronics module 424 are essentially the same as the electronics module 150' described above with the exception that the first 418 and second auxiliary electronics module 424 do not include a radio frequency receiver (see FIG. 22). The first 418 and second auxiliary electronics module 424 each comprise an AC/DC power transformer 152', a timer element 156', a garage door opener relay 410', and a solenoid relay 160' (see FIG. 22). Each of the AC to DC power transformers 152' is connected to a power supply such as a standard electrical outlet 153' or any appropriate power source. The first 418 and second auxiliary electronics module 424 are each coupled to a garage door opener 30 and to a garage door opener button 46'.

The solenoid relay 158' is activated when the radio frequency transmitter 162' sends a signal to the radio frequency receiver 154' or when the garage door opener button 46' sends a signal to the electronics module 150'. The radio frequency transmitter 162' may incorporate anti-code scanning and transmitter programmable features. When the solenoid relay 158' is activated, the solenoid 116' is energized, the pivot tab is retracted, and the dp/dt switch 400 is switched from the "off" position to the "on" position. The timer element 156' is coupled to the solenoid relay 158' and allows the solenoid relay 158' to remain activated for a specified time interval, and therefore, allows the garage door opener 30' or an operator to open the garage door 10 before the solenoid 312' is de-energized. Generally, the specified time interval can be approximately 5–10 seconds.

In addition to activating the solenoid relay 158', the signal from the radio frequency receiver 154' or garage door opener button 46' causes the electronics module 150' to send a pulsed output through the connecting wire 407 to the lock assembly.

If the dp/dt switch 400 of the lock assembly is in the "on" position, wherein the lock arm 262' is in the disengaged position, a closed loop circuit is formed such that the pulsed output passes through the dp/dp switch 400 and back through the connecting wire 407 and into the electronics module 150' to activate the garage door opener relay 410. When the garage door opener relay 410 is activated, the electric motor 44 is energized. It is noted that an integrated circuit, transistor, or the like may be used instead of a garage door opener relay to energize the electric motor 44. The timer element 156' is coupled to the solenoid relay 158' and allows the solenoid relay 158' to remain activated for a specified time interval, and therefore, allows the garage door opener 30 or an operator to open the garage door 10 before the solenoid 312' is de-energized. Generally the specified time interval can be approximately 5–10 seconds.

If the dp/dt switch 400 is in the "off" position, wherein the lock arm 262' is in the engaged position, an open loop circuit is formed such that the pulsed output does not pass through the dp/dt switch 400 and back through the connecting wire 407. Thus, the garage door opener relay 410 remains de-activated, and the electric motor 44 is not energized.

The present invention shown in FIGS. 19–22 operates in the following manner when the garage door 10 is equipped with a single garage door opener 30. Assuming the garage door 10 is closed and secured, the rod 212' is engaged in the U-shaped slot 268' of the lock 260', the lock 260' is rotated to its full counterclockwise position, the sp/st switch 406 is "on", the lock arm 262' is rotated to its full clockwise position and is engaged with the lock 260'. The solenoid 312' is de-energized, the locking pin 314' is extended, and the dp/dt switch 400 is "off".

The garage door 10 can be opened and unsecured by an operator activating the solenoid relay 158' by engaging the garage door opener button 46' or the radio frequency transmitter 162' (see FIGS. 19–22). When the solenoid relay 158' is activated, the solenoid 312' is energized, the pivot tab 264' is retracted for the specified time interval, the dp/dt switch 400 is switched from the "off" position to the "on" position, and the pivot tab 264' pulls the lock arm 262'. In addition to activating the solenoid relay 158', the signal from the radio frequency receiver 154' or garage door opener button 46' causes the electronics module 150' to send a pulsed output through the connecting wire 407 to the locking assembly 200'. With the dp/dt switch 400 in the "on" position, the garage door opener relay 410 is activated, the electric motor 44 for the garage door opener 30 is energized, and the garage door 10 is carried towards a horizontal open position. As the garage door 10 is opening, the rod 212' forces the lock 260' to rotate to its full clockwise position, and the sp/st switch 406 is switched to the "off" position. As the lock 260' rotates in the clockwise direction, the rod 212' is released.

The electric motor 44 for the garage door opener 30 automatically stops when the garage door 10 is carried to the horizontal position. The first torsion spring 284' forces the lock 260' to remain in the full clockwise position. When the specified time interval ends, the solenoid 312' is de-energized. The second torsion spring 302' causes the lock arm 262' to rotate in the clockwise direction and towards its engagement position with the lock 260',the locking pin 314' is extended, and the dp/dt switch 400 is in the "off" position.

The garage door 10 can be closed and secured by the operator activating the solenoid relay 158' by engaging the garage door opener button 461 or the radio frequency transmitter 162' (see FIGS. 19–22). When the solenoid relay 158' is activated, the solenoid 312' is energized, the pivot tab 264' is retracted for the specified time interval, the dp/dt switch 400 is switched from the "off" position to the "on" position, and the pivot tab 264' pulls the lock arm 262'. In addition to activating the solenoid relay 158', the signal from the radio frequency receiver 154' or garage door opener button 46' causes the electronics module 150' to send a pulsed output through the connecting wire 407 to the locking assembly 200'. With the dp/dt switch 400 in the "on" position, the garage door opener relay 410 is activated, the electric motor 44 is energized, and the garage door 10 is carried towards a vertical closed position where the electric motor 44 automatically stops. As the rod 212' engages with the U-shaped slot 268' of the lock 260', the lock 260' is rotated to its full counterclockwise position, the sp/st switch 406 is switched to the "on" position. When the specified time interval ends, the solenoid 312' is de-energized, the lock arm 262' is rotated to its clockwise position, the second contact surface 282' of the lock 260' is engaged with the locking surface 294' of the lock arm 262', and the dp/dt switch 400 is switched to the "off" position.

In the event that the garage door 10 is not fully closed, the garage door 10 may be adequately secured in a secondary secured position if the garage door 10 is lowered to an extent where the rod 212' engages with the U-shaped slot 268' of the lock 260', the lock 260' is rotated in a counterclockwise direction such that the first cam surface 276' of the lock 260' slides along the cam surface 296' of the lock arm 262', first contact surface 280' of the lock 260' engages with the locking surface 294' of the lock arm 262', and the sp/st switch 406 remains in the "off" position. The second and third garage doors operate in a manner similar to the first garage door.

Figure 23:
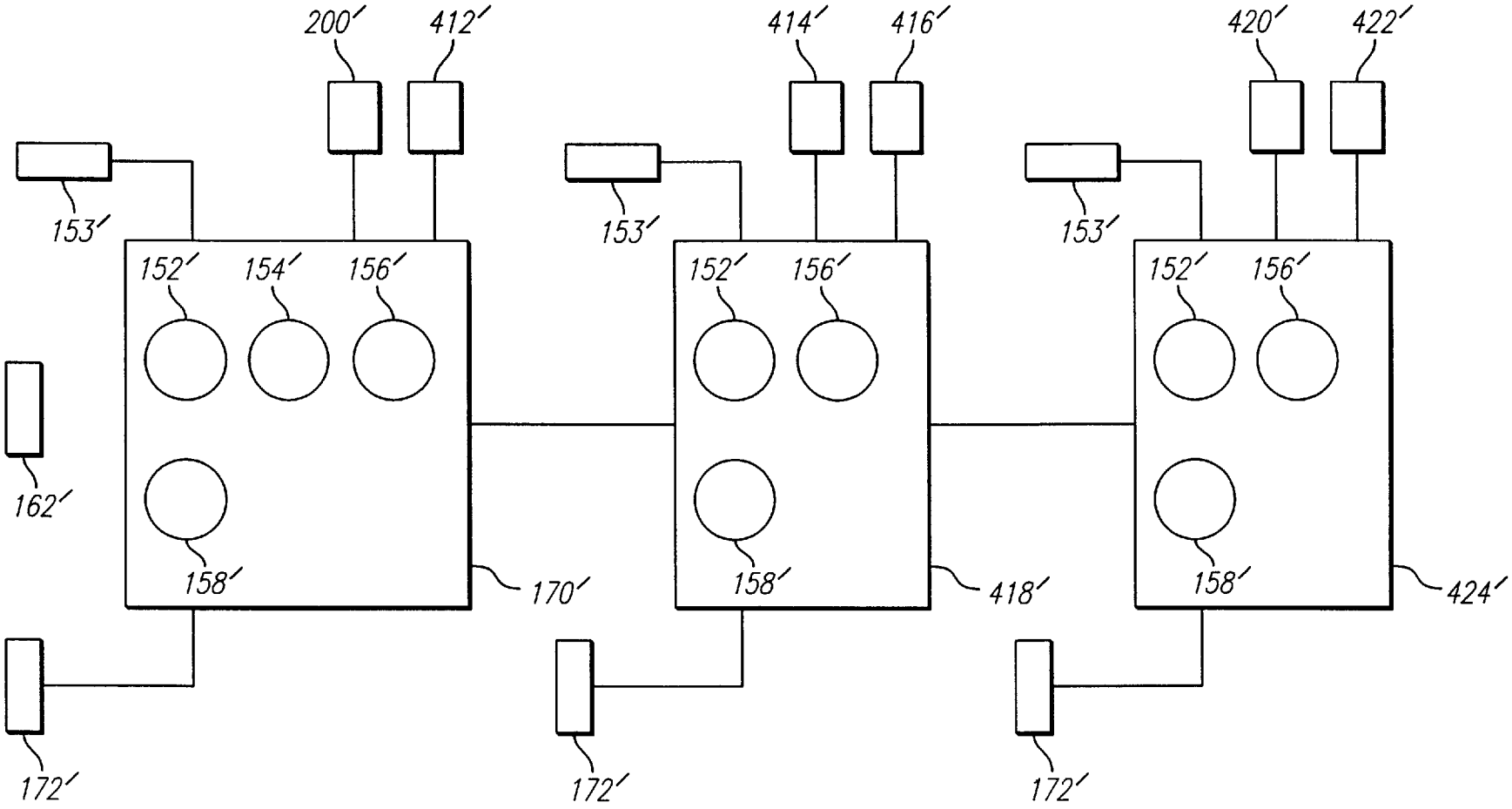
FIG. 23 is a block diagram of the electronics which controls the security device illustrated in FIG. 19 for a garage door not equipped with a garage door opener.

FIG. 23 is a block diagram of a preferred embodiment of the electronics which control the third embodiment of the security device 50 described for a garage door 10 not equipped with a garage door opener. The electronics module 170' includes an AC to DC power transformer 152', a radio frequency receiver 154', a timer element 156', and a solenoid relay 158'. The electronics module 170' is coupled to an interior solenoid switch 172, the locking assembly 200', and the radio frequency transmitter 162'.

The preferred embodiment may further include a second locking 412' which can be mounted on the support frame 15 to further secure the garage door 10. The second locking assembly 412' is essentially the same as the locking assembly 200' described above.

A second garage door (not shown) may be secured by a third locking assembly 414' and/or a fourth locking assembly 416', wherein the third 414 and/or fourth locking assembly 416 are controlled by a first auxiliary electronics module 418' (see FIG. 23). In addition, a third garage door (not shown) may be secured by a fifth 420' and/or sixth locking assembly 422', wherein the fifth 420' and sixth locking assembly 422' are controlled by a second auxiliary electronics module 424'. The first auxiliary electronics module 418' is interconnected with the first auxiliary module 424' such that the electronic modules 170', 418', 424' are connected in a daisy-like fashion. It is also noted that both the first 418' and second auxiliary module 424' may be interconnected directly to the electronics module 170'.

The third 414', fourth 416', fifth 420' and sixth locking assembly 422' are essentially the same as the first locking assembly 200' described above, and the first 418' and second auxiliary electronics module 424' are essentially the same as the electronics module 170' described above with the exception that the first 418' and second auxiliary electronics module 424' do not include a radio frequency receiver (see FIG. 23). The first 418' and secondary auxiliary electronics module 424' each comprise an AC/DC power transformer 152', a timer element 156', and a solenoid relay 158'. Each of the AC to DC power transformers 152' is connected to a power supply 153'. The first 418' and second auxiliary electronics module 424' are each coupled to a garage door opener button 172'.

The solenoid relay 158' is activated when the radio frequency receiver 162' sends a signal to the radio frequency receiver 154' or when the garage door opener button 172' sends a signal to the electronics module 170'. When the solenoid relay 158' is activated, the solenoid 312' is energized, the pivot tab 264' is retracted, and the dp/dt switch 400 is switched from the "off" position to the "on" position. The timer element 156' is coupled to the solenoid relay 158' and allows the solenoid relay 158' to remain activated for a specified time interval, and therefore, allows the operator to open the garage door 10 before the solenoid 312' is de-energized.

The present invention shown in FIGS. 19–21 and 23 operates in the following manner when the garage door 10 is not equipped with a garage door opener. Presuming the garage door 10 is closed and secured, the locking assembly 200' and rod 212' are in the same state as discussed above for the third embodiment operating in conjunction with a garage door opener. The garage door 10 can be manually opened and unsecured by an operator activating the solenoid 312' by engaging the interior solenoid switch 172' or the radio frequency transmitter 162' (see FIGS. 19–21 and 23). The electronics module 170' activates the solenoid relay 158', wherein the solenoid 312' is energized and retracts its locking pin 314' for a specified time period. The locking pin 314' pulls the pivot tab 264', the dp/dt switch 400 is switched to the "on" position, and the pivot tab 264' pulls the lock arm 262' away from its engagement with the lock 260'. As the operator manually opens the garage door 10, the rod 212' forces the lock 260' to rotate to its full clockwise position. As the lock 260' rotates in the clockwise direction, the sp/st switch 406 is switched to the "off" position, and the rod 212' is released. The first torsion spring 284' forces the lock 260' to remain in the full clockwise position. When the specified time interval ends, the solenoid 312' is de-energized, the lock arm 262' rotates to its full clockwise position, the locking pin 314 is extended, and the dp/dt switch 400 is switched to the "off" position. The lock 260' remains stationary, and is positioned to accept the rod 212'.

The garage door 10 can be closed and secured by manually closing the garage door 10 (see FIGS. 19–21 and 23). When the operator closes the garage door 10, the rod 212' begins to engage the U-shaped slot 268' of the lock 260', thereby causing the lock 260' to rotate in a counterclockwise direction against the force of the first torsion spring 284', the cam surface 296' of the lock arm 262' slides along the first 276' and second cam surface 278' of the lock 260', and the sp/st switch 406 is switched to the "on" position. The garage door 10 is once again closed and secured when the rod 212' is engaged in the U-shaped slot 268' of the lock 260', the lock 260' is rotated to its full counterclockwise position, and the lock arm 262' is rotated to its clockwise position and engaged with the lock 260'. The second and third garage doors may be operated in a manner similar to the first garage door.

Referring to FIG. 24, a detailed schematic of the electronics module 150' for the third embodiment of the security device 50 described for a garage door 10 equipped with a garage door opener 30. A list of various components for the electronics module 150' is shown in Table 1.

TABLE 1

| | |
|---|---|
| Plugs | |
| P1 | 24 vdc input from transformer/adapter |
| Wires | |
| 3 | To/from garage door opener switch |
| 4 | To/from garage door opener switch |
| 5 | To/from garage door opener |
| 6 | To/from garage door opener |
| 7 | To/from home security system |
| 8 | To/from home security system |
| 9 | Output controlled by the transmitter to activate relay used to disarm home security system |
| 10 | 12 vdc (−) output to activate relay used to disarm home security system |
| Phone jack connectors | |
| PJ1 | Connector where lock one plug in |
| PJ2 | Connector where lock two plugs in |
| PJ3 | Used to connect the auxiliary control modules * to the main control module |
| PJ4 | used to connect the auxiliary control modules * to the main control module |
| Relays | |
| 1 | Activates the garage door opener |
| 2 | Activates the solenoid |
| Jumpers | |
| 1 | Used to recognize that there is no receiver in the module (only in the auxiliary module *) |
| 2 | Controls the timed output length for solenoid relay activation |
| 3 | Tells the control module if there is 1 or 2 locks plugged into the module (security loop) |
| 4 | Tells the control module if there is 1 or 2 locks plugged into the module (GDO relay loop) |
| 5 | Used to determine if transmitter button 2 or 3 activates the control module (only in the auxiliary module *) |
| Integrated Circuits | |
| IC1 | Converts the 24 vdc input into l2 vdc output |
| IC2 | Converts the 12 vdc output of IC1 into 5 vdc output |
| IC3 | The PIC (programmable integrated circuit) that controls most of the lock and control module functions including timing functions, activates all relays, provides the activation outputs for the auxiliary control modules *, controls the code-rolling sequence of the receiver and controls the transmitter learning feature and confirmation LED1. |

TABLE 1-continued

| | |
|---|---|
| IC4 | Controls the transmitter learning process of the receiver (used only in the main control module) |
| Receiver | |
| RF1 | Receives the signal from the transmitter to activate the control module (used only in main control module) |
| Switches | |
| 1 | On-board switch for transmitter learning (used only in the main control module) |
| A | Mounted in the lock: Controls Relay 1 and the security loop circuit |
| B | Mounted in the lock: Controls the security loop circuit |
| LED | |
| 1 | used to visually identify transmitter learning process (used only in the main control module) |

*The auxiliary control modules are for controlling locks mounted to the second and third doors in the same garage, utilizing the transmitters of the main control module when connected to PJ3 or PJ4.

The electronics module 150 comprises a programmable integrated chip (PIC) 426, the radio frequency receiver 154', an integrated circuit chip 428, the solenoid relay 158', and the garage door opener relay 410. The PIC 426 controls all timing functions, activates the solenoid relay 158' and garage door opener relay 410, provides activation outputs for the first 418 and second auxiliary electronics module 424, controls a code-rolling sequence of the radio frequency receiver 154', and controls the transmitter learning feature of the integrated chip 428.

In operation, when the radio frequency transmitter 162' sends a signal to the radio frequency receiver 154' or when the garage door opener button 461, 172' sends a signal to the electronics module 150', 170', the PIC 426 sends a timed output signal to phone jacks 432, 434, through the connecting wire 407, and to the solenoid relay 158' (see FIGS. 19–24). In regards to the garage door opener circuit, when the solenoid relay 158' is activated, the solenoid 312' is energized, the lock arm 262' is rotated to its disengaged position, and the dp/dt switch 400 is switched to the "on" position.

In addition to activating the solenoid relay 158', the signal from the radio frequency receiver 154' or garage door opener button 46' causes the PIC 426 to send a pulsed output through a jumper 430 to determine whether there is one or two lock assemblies 200' connected to the electronics module 150'. With the dp/dt switch 400 being in the "on" position, the pulsed output is sent through the connecting wire to the locking assembly 200' and back through the connecting wire and into the electronics module 150' to activate the garage door opener relay 410. When the garage door opener relay 410 is activated, the electric motor 44 for the garage door 10 is energized, and the garage door 10 is opened.

A security system (not shown) can also be connected to the electronics module 150' by wires 436, 438 to alert the security system that an unauthorized intrusion has been attempted through the garage door 10, that the garage door 10 is not secured, that the manual release member 326' is left in the unsecured position, or that the lock assembly 200' or connecting wires 407, 436, 438 have been tampered with. The security system feeds a signal into the electronics module 150' through the phone jacks 432, 434, and the signal is then sent through the connecting wire to the lock assembly 200'. In regards to the security loop circuit, the dp/dt switch 400 is in the "on" position when the lock arm 262' is in the engaged position and in the "off" position when the lock arm 262' is in the disengaged position. If dp/dt switch 400 and the sp/st switch 406 are both in the "on" position, the signal is sent back to the electronics module 150', and back to the security system.

Although the present invention has been described in detail with regarding the exemplary embodiments and drawings thereof, it should be apparent to those skilled in the art that various adaptations and modifications of the present invention may be accomplished without departing from the spirit and scope of the invention. For instance, the primary locking gear 57, secondary gear 80, and latch hook 94 can all rotate about protrusions extending from the base 54 and lid 56 in such a manner that the protrusions from the base do not contact the protrusions from the lid 56. Instead of rotatively coupling the rectangular teeth 59 of the primary locking gear 57 with the rectangular teeth 83 of the secondary gear 80, the primary locking gear 57 can be rotatively coupled to the secondary gear 80 by a chain. Instead of coupling the solenoid 116 and latch hook 94 by a braided wire 120, the solenoid 116 can be coupled to the latch hook 94 by a linkage mechanism. Instead of using solenoids 116, 280 to rotate the latch hook 94 or lock arm 262, an electric motor can be used to rotate the latch hook 94 or the lock arm 262. Furthermore, the electronics of the present invention may be designed to operate with the position sensors being normally in the open or "off" position. Accordingly, the invention is not limited to the precise embodiment shown in the drawings and described in detail hereinabove.

What is claimed is:

1. A combination movable overhead closure and security device for selectively securing and unsecuring a movable overhead closure to a support frame, the combination comprising:

a movable overhead closure;

a support frame supporting the movable closure;

a locking assembly attached to one of the movable closure and the frame, the locking assembly comprising:

a locking element having a detent;

a latching element being selectively engageable with the locking element from an engaged position to a disengaged position;

a pivoting element coupled to the latching element;

a pivot element position sensor coupled to the pivot element, the position sensor indicating whether the latching element is in its engaged position or in its disengaged position; and a securing element attached to the other one of the movable closure and the frame;

wherein when the movable closure is secured, the detent of the locking element is securely coupled with the securing element and the position sensor indicates that the latching element is in its engaged position.

2. The combination movable overhead closure and security device of claim 1, wherein the latching element has an opening and wherein the pivoting element is coupled to the latching element through the opening.

3. The combination movable overhead closure and security device of claim 1, wherein the locking element is movable from a secured position to an unsecured position and wherein the combination movable closure and security device further comprises a locking element position sensor coupled to the locking element, the locking element position sensor indicating whether the locking element is in its secured position or in its unsecured position, wherein when the closure is secure the locking element position sensor indicates that the locking element is in its secured position.

4. The combination movable overhead closure and security device of claim 3, wherein the pivot element position sensor and the locking element position sensor are switches.

5. The combination movable overhead closure and security device of claim 4, wherein the pivot element position sensor is a double pole/double throw switch and the locking element position sensor is a single pole/single throw switch.

6. The combination movable overhead closure and security device of claim 3, further including an actuator coupled to the pivoting element.

7. The combination movable overhead closure and security device of claim 6, wherein the actuator has an element that is movable from a first position to a second position when the actuator is activated.

8. The combination movable overhead closure and security device of claim 7, wherein the actuator is a solenoid.

9. The combination movable overhead closure and security device of claim 6, wherein the closure is movable from a closed to an opened position and is movable from an opened to a closed position with an automatic opening device, wherein the automatic opening device includes a motor element, the motor element being coupled with the closure and moving the closure from its closed position to its opened position and from its opened position to its closed position when activated.

10. The combination movable overhead closure and security device of claim 9, further comprising an electronics module coupled to the locking assembly, the electronics module comprising:

a first relay coupled to the actuator, wherein activation of the first relay energizes the actuator such that the actuator causes the latching element to be moved to its disengaged position; and a second relay coupled to the pivot element position sensor, wherein when the pivot element position sensor indicates that the latching element is in its disengaged position, the second relay is activated and the motor element is energized, and wherein when the pivot element position sensor indicates that the latching element is in its engaged position, the second relay remains deactivated and the motor element remains de-energized.

11. The combination movable overhead closure and security device of claim 10, wherein the electronics module is coupled to a security system.

12. The combination movable overhead closure and security device of claim 11, wherein the security system is coupled to the pivot element position sensor and the locking element position sensor, wherein the security system receives a signal indicating a secured state when the pivot element position sensor indicates the latching element being in its engaged position and the, locking element position sensor indicates the locking element being in its secured position.

13. The combination movable overhead closure and security device of claim 12, further comprising a timer element coupled to the first relay, wherein the timer element allows the movable closure to be opened before the actuator is de-energized.

14. The combination movable overhead closure and security device of claim 13, wherein the electronics module further includes an integrated circuit chip, the integrated circuit chip coupled to the first relay, the second relay, the position sensor, the additional position sensor, the actuator, the security system, and the timer clement, wherein the integrated circuit chip controls the first relay, the second relay, the actuator, and the timer element.

15. The combination movable overhead closure and security device of claim 10, further comprising a manual release element coupled to the latching element.

16. The combination movable overhead closure and security device of claim 10, wherein the security device is capable of securing more than one movable closure to its respective supporting frame.

17. The combination movable overhead closure and security device of claim 6, further including an electronics module coupled to the locking assembly, the electronics module comprising:

a relay coupled to the actuator, wherein activation of the relay causes the actuator to be energized which causes the actuator to rotate the latching element to its disengaged position;

a timer element coupled to the relay, wherein the timer element allows the movable closure to be manually opened before the actuator is de-energized; and an integrated circuit chip for controlling the electronics module, the integrated circuit chip coupled to the relay, the pivot element position sensor, the locking element position sensor, the actuator, and the timer element.

18. The combination movable overhead closure and security device of claim 17, wherein the electronics module is coupled to a security system.

19. The combination movable overhead closure and security device of claim 18, wherein the security system is coupled to the pivot element position sensor and the locking clement position sensor, wherein the security system receives a signal indicating a secured state when the pivot element position sensor indicates the latching element is in its engaged position and the locking element position sensor indicates that the locking element is in its locked position.

20. The combination movable overhead closure and security device ofclaim 19, further including a manual release element coupled to the latching element.

21. The combination movable overhead closure and security device of claim 20, wherein the electronics module further includes an integrated circuit chip, the integrated circuit chip being coupled to the relay, the position sensor, the additional position sensor, the actuator, the security system, and time element, wherein the integrated circuit chip controls the first relay, the second relay, the actuator, and the timer element.

22. The combination movable overhead closure and security device of claim 21, wherein the electronics module and the locking assembly each include a phone jack connector, and the electronics module is coupled to the locking assembly by a wire connected to each of the phone jack connectors.

23. The combination movable overhead closure and security device of claim 2, wherein the movable closure is a garage door.

24. The combination movable overhead closure and security device of claim 2, wherein the securing element is a rod.

25. The combination movable overhead closure and security device of claim 3, wherein the movable closure is a roll-down door.

26. The combination movable overhead closure and security device of claim 1, wherein the locking element and the latching element are formed from metal-reinforced plastic.

27. A method for securing a movable overhead closure to a support frame, the method comprising the steps of:

attaching a securing element to one of the movable closure and the frame;

attaching a locking assembly to the other one of the movable closure and the support frame, the locking assembly comprising:

a locking element having a detent:

a latching element being selectively engageable with the locking element;

a pivoting element coupled to tie latching clement;

a pivot clement position sensor coupled to the pivoting element, the first position sensor indicating whether latching element is in the engaged position or in the disengaged position; and securing the movable closure to the support frame by moving the movable closure to its closed position, causing the securing element to engage the detent of the locking element, causing the locking element to rotate about its axis, causing the latching clement to contact and engage the locking element.

28. The method of claim 27, further comprising the steps of:

coupling an actuator element to the pivoting element, the actuator element having an element movable from a first position to a second position; and unsecuring the movable closure from the support fame by providing an electrical signal to activate the actuator element, thereby causing the actuator element to move from its first position to its second position, causing the latching element to rotate and disengage from the locking element, causing the locking clement to rotate, and allowing the securing element to become uncoupled from the detent.

29. The method of claim 28, further comprising the step of providing the locking assembly with a locking element position sensor, whereby the locking element position sensor is coupled to the locking element, the additional position sensor indicating whether the locking element is in its secured position or in its unsecured position;

whereby when the movable closure is secured, the detent of the locking element is securely coupled with the securing element and the position sensor indicates the pivoting element is in the engaged position and the additional position sensor indicates the locking element being in the secured position.

30. The method of claim 29, wherein the actuator is a solenoid.

31. The method of claim 30, further comprising the steps of:

providing at least one of an RF transmitter coupled to the locking assembly by RF energy and a closure switch coupled to the locking assembly by wires;

providing an automatic opening device having a motor element to move the movable closure from a closed position to an opened position and from an opened position to a closed position, whereby the motor element is energized to move the closure from the closed position to the opened position; and coupling an electronics nodule to the locking assembly and to the motor element, the electronics module comprising:

a first relay coupled to the actuator, whereby activation of the first relay energizes the actuator such that the actuator rotates the latching clement to the disengaged position; and a second relay coupled to the position sensor, whereby when the position sensor indicates that the latching element is in the disengaged position, the second relay is activated and the motor element is energized, and whereby when the pivot element position sensor indicates that the latching element is in the engaged position, the second relay deactivated and the motor element remain de-energized.

32. The method of claim 31, further comprising the step of coupling a timer element to the first relay, whereby the timer element allows the closure to be opened before the actuator is de-energized.

33. The method of claim 32, further comprising the step of coupling a manual release member to the latching element, whereby the movable closure may be unsecured by moving the manual release member from a secured position to an unsecured position.

34. The method of claim 33, further comprising the step of providing an integrated circuit chip for controlling the first relay, the second relay, the position sensor, the additional position sensor, the actuator, the security system, and the timer element.

35. The method of claim 31, further comprising the step of coupling the electronics module to a security system.

36. A combination movable overhead closure and security device for selectively securing and unsecuring the movable closure to a support frame, the combination comprising:

a movable overhead closure selectively movable from a closed position to an opened position;

a support frame for supporting the movable closure;

a motor element, the motor element being coupled with the movable closure and moving the movable closure from its closed position to its opened position and from its opened position to its closed position when activated;

a securing element attached to one of the movable closure and the support frame;

a locking assembly attached to the other on of the movable closure and the support frames the locking assembly being movable from a secured to an unsecured position; and a position sensor indicating whether the locking assembly is in its secured position:

wherein the locking assembly is coupled with the securing element when it is in its secured position; and wherein when the locking assembly is in an unsecured position, a signal passes through the position sensor to energize the motor element.

* * * * *